US008201914B2

(12) United States Patent
Hirato

(10) Patent No.: US 8,201,914 B2
(45) Date of Patent: Jun. 19, 2012

(54) INKJET RECORDING APPARATUS

(75) Inventor: Katsuyuki Hirato, Haibara-gun (JP)

(73) Assignee: FUJIFILM Corporation, Tokyo (JP)

( * ) Notice: Subject to any disclaimer, the term of this patent is extended or adjusted under 35 U.S.C. 154(b) by 282 days.

(21) Appl. No.: 12/570,069

(22) Filed: Sep. 30, 2009

(65) Prior Publication Data

US 2010/0020123 A1 Jan. 28, 2010

Related U.S. Application Data

(62) Division of application No. 11/776,154, filed on Jul. 11, 2007, now Pat. No. 7,681,978.

(30) Foreign Application Priority Data

Jul. 11, 2006 (JP) ..... 2006-190446

(51) Int. Cl.
*B41J 29/393* (2006.01)

(52) U.S. Cl. ..... 347/19

(58) Field of Classification Search ..... 347/19, 347/13, 42, 105, 16
See application file for complete search history.

(56) References Cited

U.S. PATENT DOCUMENTS

2002/0090243 A1 7/2002 Hosokawa et al.
2003/0210943 A1 11/2003 Nedblake et al.
2006/0132527 A1 6/2006 Corery et al.

FOREIGN PATENT DOCUMENTS

EP 1486343 A2 12/2004
JP 2001-277673 A 10/2001

OTHER PUBLICATIONS

Extended European Search Report dated Mar. 1, 2010 issued in counterpart Application No. 09015887.4.

*Primary Examiner* — Lamson Nguyen
(74) *Attorney, Agent, or Firm* — Sughrue Mion, PLLC

(57) ABSTRACT

An inkjet recording apparatus includes: a full-line inkjet head that includes ejection nozzles arrayed in the width direction of a recording medium, and that ejects a liquid functional material on the recording medium; a conveying unit that conveys the recording medium at a position opposite to the full-line inkjet head; a test image formation sheet-feeding unit that contact-feeds a test image formation sheet on the recording medium in the upstream of the ejection position on the conveying unit; and a test image formation sheet-separating unit that separates the test image formation sheet from the recording medium in the downstream of the ejection position on the conveying unit.

4 Claims, 7 Drawing Sheets

INKJET RECORDING APPARATUS

This is a divisional of application Ser. No. 11/776,154 filed Jul. 11, 2007. The entire disclosure of the prior application, application Ser. No. 11/776,154 is considered part of the disclosure of the accompanying divisional application and is hereby incorporated by reference.

BACKGROUND OF THE INVENTION

1. Field of the Invention

The present invention relates to an inkjet recording apparatus for performing image evaluation of an image which is formed on a recording medium by an inkjet method using a liquid functional material (ink).

2. Background Art

The engineering/industrial printing utilizing an inkjet system is advantageous to small-lot printing and its development is being increasingly promoted in recent years. Particularly, an active energy curing-type inkjet recording apparatus in which a liquid functional material (ink) capable of being cured by active energy such as electron beam and ultraviolet ray is fed, ejected on a recording medium by using an inkjet head and cured under energy irradiation, thereby performing image formation, is assured of characteristic features, in terms of the property of the ink itself, which can satisfy various requirements such as high-speed recording on a recording medium, less blurring and high-definition image, and environment-friendliness. Above all, as for the apparatus using an ink curable by an ultraviolet ray which is the active energy, several systems have been proposed in view of easy handling of the light source, compact fabrication and the like. Furthermore, when a full-line type inkjet head having a plurality of heads arranged to cover the entire width of the recording medium and an ultraviolet-curable ink requiring no drying step in many cases are combined, higher-speed recording can be achieved.

The inkjet recording apparatus using a full-line type inkjet head has many ejection nozzles and therefore, when ejection failure of the ejection nozzle occurs, this is visible as an image defect. In an inkjet recording apparatus required to process a large amount of image, a roll paper-feeding system of forming an image on a continuous recording medium is generally employed. In the roll paper-feeding system, the recording medium continues from before image drawing until take-up through processing and an arbitrary image of, for example, a recording medium having formed thereon a pattern for image evaluation is difficult to directly take out immediately after the image formation and confirm with an eye.

On the other hand, in order to keep constant the image quality, it is necessary to periodically or aperiodically perform image evaluation, for example, at the exchange of inkjet head or after image formation on a large number of sheets, and feed back the evaluation results. Conventionally, the image evaluation of an image formed by a full-line type inkjet recording apparatus using such a continuous recording medium has been effected by stopping the image formation and observing the image on the recording medium or performing on-line scanning (see, for example, JP-A-2001-277673 (the term "JP-A" as used herein means an "unexamined published Japanese patent application").

However, in the image evaluation on the recording medium, the image formation must be stopped, or a plurality of evaluation images cannot be compared and evaluated or can be hardly compared under a correct light source, making it difficult to perform image evaluation sufficient to keep constant the image quality.

In the inkjet recording apparatus disclosed in JP-A-2001-277673, a test pattern is printed in the state of a roll paper (continuous recording medium) being held between a pair of paper conveying/holding roller and paper discharging roller, and the image formed on the roll paper is read in an imaging part comprising an image pickup device such as CCD (on-line scanning) while again conveying the roll paper after once unrolling it or while conveying the roll paper in the direction opposite to that at the printing, whereby image evaluation is performed. However, there is a problem that reading of the image takes much time, making it mandatory to decrease the operation efficiency or sacrifice the evaluation accuracy by reducing the image resolution, and the image formed on the roll paper cannot be evaluated efficiently and properly.

SUMMARY OF THE INVENTION

Under these circumstances, the present invention has been made and an object of the present invention is to provide an inkjet recording apparatus ensuring that image evaluation of an image formed on a continuous recording medium by a full-line type inkjet head can be efficiently and properly performed.

The object of the present invention can be attained by the following constructions.

(1) According to a first aspect of the present invention, an inkjet recording apparatus comprising: a full-line inkjet head that includes ejection nozzles arrayed in the width direction of the recording medium, and that ejects a liquid functional material on a continuous recording medium; a conveying unit that conveys the recording medium at a position opposite to the full-line inkjet head; a test image formation sheet-feeding unit that contact-feeds a test image formation sheet on the recording medium in the upstream of the ejection position on the conveying unit; and a test image formation sheet-separating unit that separates the test image formation sheet from the recording medium in the downstream of the ejection position on the conveying unit.

According to the thus-constructed inkjet recording apparatus, conveying means for conveying the recording medium at the ejection position of the inkjet head, test image formation sheet-feeding means for contact-feeding a test image formation sheet on the recording medium in the upstream of the ejection position on the conveying means, and test image formation sheet-separating means for separating the test image formation sheet from the recording medium in the downstream of the ejection position on the conveying means are provided, so that after forming a test image on the test image formation sheet fed on the recording medium by the test image formation sheet-feeding means, the test image formation sheet having formed thereon the test image can be separated from the recording medium by the test image formation sheet-separating means. This enables performing image evaluation by easily taking out the test image formation sheet alone separately from the recording medium on which a normal image is formed, as a result, an image always having a constant quality can be formed by performing image evaluation without affecting the image forming operation on the recording medium.

(2) According to a second aspect of the present invention, an inkjet recording apparatus comprising: a full-line inkjet head that includes ejection nozzles arrayed in the width direction of the recording medium, and that ejects a liquid functional material on a continuous recording medium; a conveying unit that conveys the recording medium at a position opposite to the full-line inkjet head; a die-cutting mechanism that die-cuts the recording medium at least partially as a test image formation sheet; and a test image formation sheet-separating unit that separates the test image formation sheet from the recording medium in the downstream of the ejection position on the conveying unit.

According to the thus-constructed inkjet recording apparatus, the recording medium can be die-cut as a test image formation sheet and the test image formation sheet contact-feeding mechanism can be dispensed with. Also, the height of the test image formation sheet and the height of the recording medium are equal and therefore, it is not necessary to adjust the recording medium-to-head distance.

Furthermore, when the recording medium is a recording medium for label printing having a structure that a self-adhesive sheet having coated on the back surface thereof a pressure-sensitive adhesive is superposed on a release paper working as a board, only the self-adhesive sheet part can be die-cut.

(3) The inkjet recording apparatus as described in the item (1) or (2), wherein the conveying unit comprises a recording medium-to-head distance-adjusting mechanism that moves at least one of the recording medium and the inkjet head in the horizontal direction with respect to the ejection direction of the full-line inkjet head so as to set distance between the test image formation sheet and the full-line inkjet head to an optimal value for ejection.

According to the thus-constructed inkjet recording apparatus, the conveying means comprises a recording medium-to-head distance-adjusting mechanism and can move at least either one of the recording medium and the inkjet head so as to set the distance between the test image formation sheet and the inkjet head to an optimal value for ejection and therefore, the same good image as that in the normal image recording can be formed by adjusting the distance between the test image formation sheet fed on the recording medium and the inkjet head to an optimal value for ejection. This enables properly performing the image evaluation.

(4) The inkjet recording apparatus as described in any one of the items (1) to (3), further comprising an image analyzing unit that scan-reads and analyzes the test image on the test image formation sheet separated by the test image formation sheet-separating unit, and that feeds back the analysis results to an image recording.

According to the thus-constructed inkjet recording apparatus, the image analyzing means is designed to scan-read and analyze the test image on the test image formation sheet after separation and feed back the analysis results to actual image recording, so that in addition to the evaluation with an eye, the image evaluation can be automatically performed by the image analyzing means and a good image can be formed by feeding back the evaluation results.

(5) The inkjet recording apparatus as described in any one of the items (1), (3) and (4), wherein the test image formation sheet-feeding unit brings the test image formation sheet into close contact with the recording medium by electrostatic adsorption or by using a pressure-sensitive adhesive.

According to the thus-constructed recording medium, the test image formation sheet-feeding means is designed to bring the test image formation sheet into close contact with the recording medium by electrostatic adsorption or by using a pressure-sensitive adhesive, so that image formation failure ascribable to, for example, lifting of the test image formation sheet from the recording medium can be prevented and image evaluation can be performed by forming a good test image.

(6) The inkjet recording apparatus as described in any one of the items (1) to (5), wherein the test image formation sheet-separating unit separates the test image formation sheet from the recording medium by electrostatic adsorption or by using a self-adhesive roller.

According to the thus-constructed inkjet recording apparatus, the test image formation sheet-separating means is designed to separate the test image formation sheet from the recording medium by electrostatic adsorption or by using a self-adhesive roller, so that the test image formation sheet can be unfailingly separated from the recording medium.

(7) The inkjet recording apparatus as described in any one of the items (1) to (6), wherein the test image formation sheet-feeding unit feeds the test image formation sheet on the recording medium at predetermined time intervals at least one of in forming the image and in sleeping an image formation.

According to the thus-constructed inkjet recording apparatus, the test image formation sheet-feeding means is designed to feed the test image formation sheet on the recording medium at predetermined time intervals despite progress of the image formation, so that image evaluation can be performed by feeding the test image formation sheet at predetermined time intervals without interrupting the image formation on the recording medium. This enables maintaining the reliability of the inkjet recording apparatus.

The predetermined time needs to be a time before occurrence of possible problems in the image formation and is set to, for example, 10 minutes before the time at which an ejection failure of the ejection nozzle is predicted to occur.

According to the inkjet recording apparatus of the present invention, an inkjet recording apparatus capable of efficiently and properly performing the image evaluation of an image which is formed on a continuous recording medium by a full-line type inkjet head, can be provided.

BRIEF DESCRIPTION OF THE DRAWINGS

The invention disclosed herein will be understood better with reference to the following drawings of which.

DETAILED DESCRIPTION OF THE INVENTION

Figure 1:
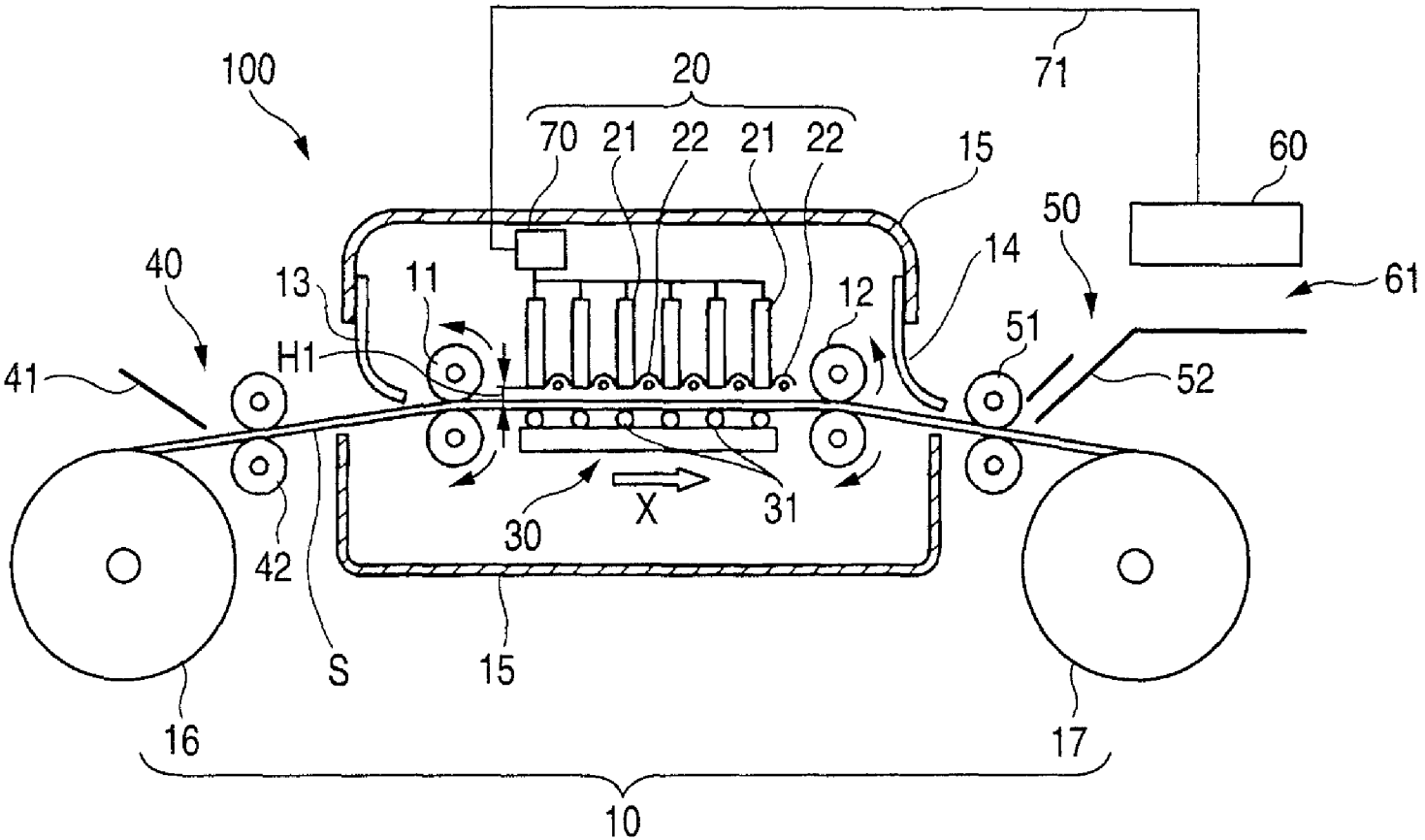
FIG. 1 is a schematic constitutional view of the inkjet recording apparatus.

The inkjet recording apparatus of the present invention is described in detail below by referring to the drawings. FIG. 1 is a schematic constitutional view of the inkjet recording apparatus.

The inkjet recording apparatus 100 comprises a scan-conveying part 10 as the conveying means, an image forming part 20, a recording medium-to-head distance adjusting mechanism 30, test medium feeding means 40, test medium separating means 50, image analyzing means 60, a head drive control part 70, and recording apparatus control means (e.g., PC) between the image analyzing means 60 and the head driving control part 70.

In FIG. 1, within a casing 15 of the active energy curing-type inkjet recording apparatus 100, a continuous recording medium S wound around a delivery-side roll 16 is extracted by a conveying roller 42 and conveyed into the casing 15 through a flexible light-shielding door 13. The continuous recording medium S conveyed is delivered from a flexible light-shielding door 14 disposed on the opposite side of the casing 15 and taken up on a takeup-side roll 17. Depending on the use mode, the medium may be after-processed without being taken up or may be subjected to a surface treatment such as varnish coat before taking up.

The continuous recording medium S conveyed into the casing 15 is held by conveying/holding rollers 11 and delivered on a plurality of supporting/conveying rollers 31. Furthermore, the continuous recording medium S is held by conveying/holding rollers 12 disposed on the downstream side across the supporting/conveying rollers 31, scan-conveyed on the supporting/conveying rollers 31, and delivered from the light-shielding door 14. Above the supporting/conveying rollers 31, an image forming part 20 is disposed at the opposing position across the recording medium S. In this way, the scan-conveying part 10 is formed by a delivery-side roll 16, a takeup-side roll 17, conveying rollers 42 and 51, conveying/holding rollers 11 and 12, and supporting/conveying rollers 31. In the image forming part 20, inkjet image recording and fixing by irradiation of active energy (in this embodiment, ultraviolet light) are performed on the continuous recording medium S under scan-conveyance on the supporting/conveying rollers 31. An ink reservoir part for reserving ink and feeding the ink to the image forming part 20 through a feed line (not shown) is provided in the casing 15.

The scan-conveying part 10 comprises a recording medium-to-head distance adjusting mechanism 30 having conveying/holding rollers 11 and 12 and a plurality of supporting/conveying rollers 31. The recording medium-to-head distance adjusting mechanism 30 is driven by a driving mechanism (not shown) and can move the continuous recording medium S to the direction closer to or remoter from ejection nozzles (not shown) of inkjet heads 21, whereby the distance between the inkjet head 21 and a test image formation sheet TS and the distance between the inkjet head 21 and the continuous recording medium S are controlled to an optimal value for ejection.

In the image forming part 20, a plurality of full-line type inkjet heads 21 (in the embodiment shown in FIG. 1, six inkjet heads) corresponding to respective colors are integrally disposed. Each full-line type inkjet head 21 is, for example, a piezo-type head, and many ejection nozzles are arrayed with high positional precision over the entire region in the width direction (direction perpendicular to the paper showing the drawing) of the continuous recording medium S while facing the continuous recording medium S. A head drive control part 70 is connected to the full-line type inkjet heads 21 and controls the ejection amount, ejection timing or the like of each color ink.

An ultraviolet irradiation part 22 of irradiating an ultraviolet ray is disposed on the downstream side of each inkjet head 21 and cures ink immediately after its landing on the continuous recording medium S by applying energy high enough to cure the ink. The arrangement of the ultraviolet irradiation part 22 is constituted to allow the irradiation only in the direction of ink landed on the recording medium S and not allow the irradiation on the ink ejection port of the inkjet head 21, whereby the curing of ink at the ejection port is prevented. The parts in the vicinity of the ultraviolet irradiation part 22 each is preferably subjected to a treatment for preventing light reflection (for example, a black matting treatment). In each ultraviolet irradiation part, the light amount or distance to the continuous recording medium S is controlled by an ultraviolet irradiation condition control part (not shown). A measuring meter for measuring the light amount or a counter for recording the operating time may be provided in the ultraviolet control part.

The test medium feeding means 40 is provided on the upstream side of the inkjet head 21 and feeds a test image formation sheet TS on the continuous recording medium S from the upstream of the inkjet head 21. By the test image formation sheet-feeding means 40, a test image formation sheet TS inserted from a stocker (not shown) stockpiling the test image formation sheet TS or manually inserted from the recording medium insertion port (not shown) is guided using a guide plate 41 and guide rollers 42 and fed on the continuous recording medium S under conveyance by the scan-conveying part 10. The test image formation sheet-feeding means 40 puts the test image formation sheet TS into close contact with the recording medium S by electrostatic adsorption or by using a pressure-sensitive adhesive.

Figure 6:
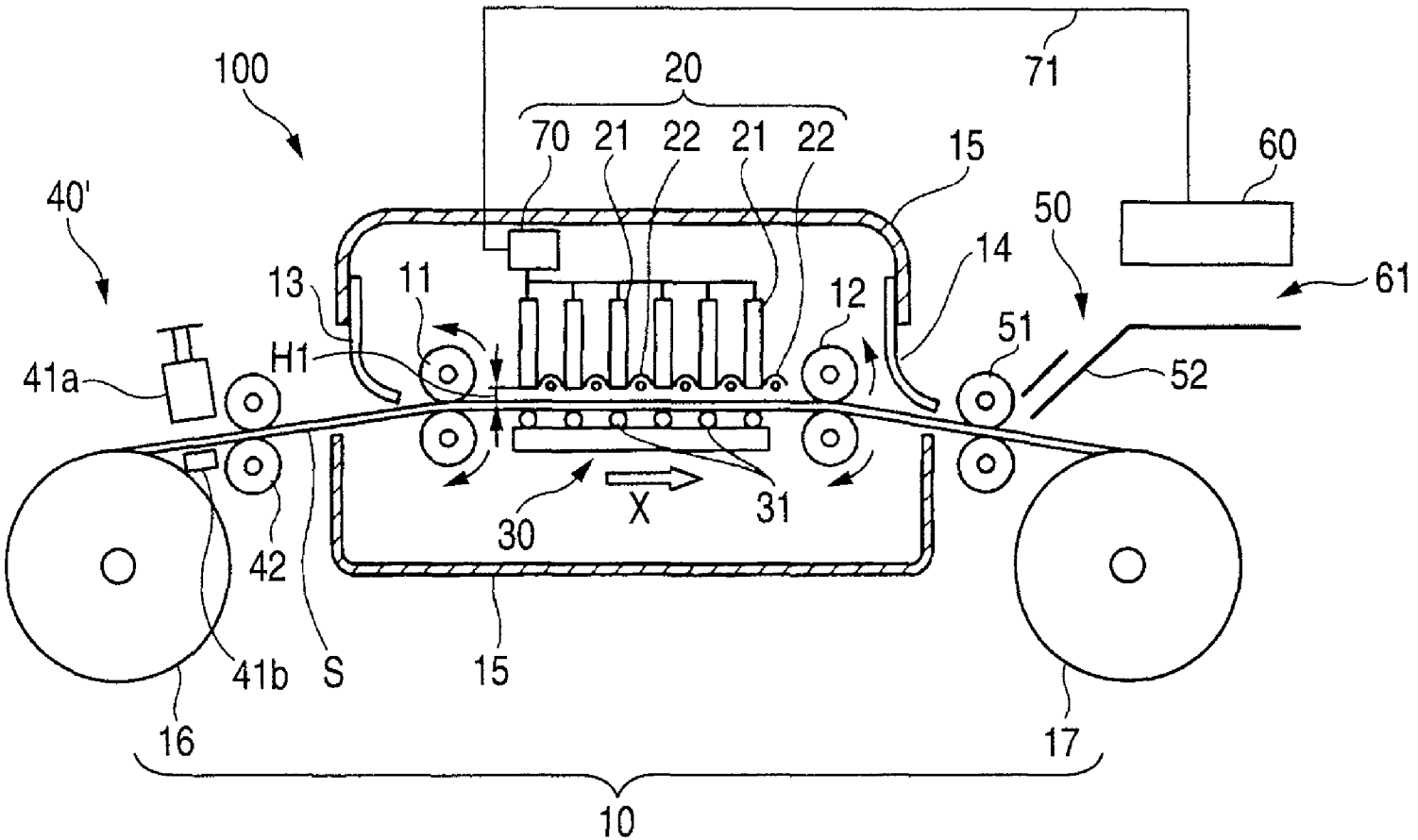
FIGS. 6 and 7 are schematic constitutional views of additional embodiments of the inkjet recording apparatus.
Figure 7:
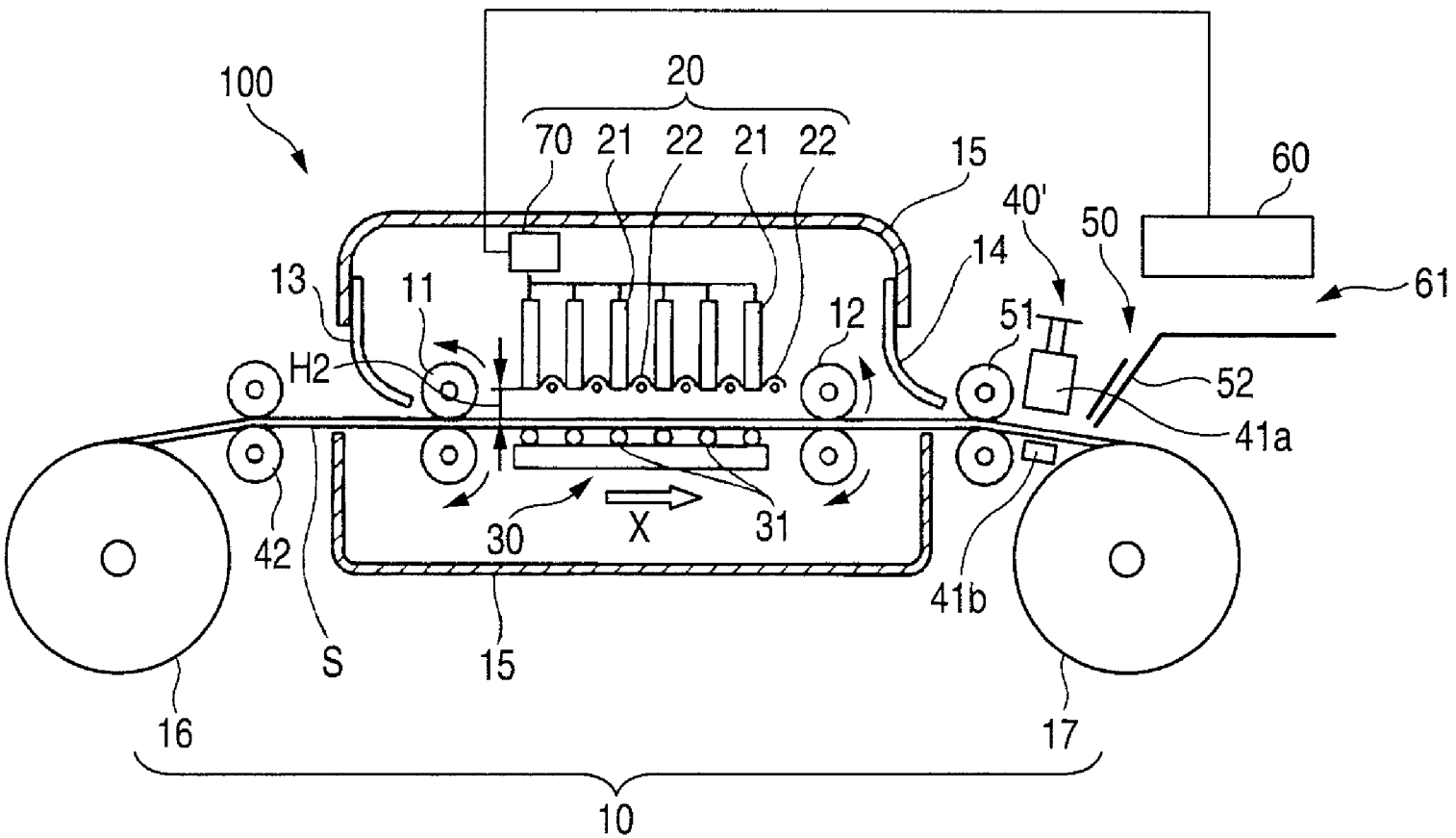

The test image formation sheet-separating means 50 comprises an electrostatic adsorption roller or self-adhesive roller 51 using the same means as the adsorption means (electrostatic adsorption or a pressure-sensitive adhesive) of the test image formation sheet-feeding means 40 and a guide plate 52 and is provided on the downstream side of the inkjet head 21. By the test image formation sheet-separating means 50, the test image formation sheet TS on which an image is formed in the image forming part 20 and which is conveyed while lying on the continuous recording medium S, is separated from the recording medium S in close contact therewith and conveyed to the evaluation stage 61. The test image formation sheet-separating means 50 may be a separation claw provided on the downstream side of the inkjet head 21, and the distal end of the separation claw may also be designed to promote the separation of the test image formation sheet TS from the continuous recording medium S. In the case where the recording medium is in a seal form, the test image formation sheet-feeding means 40 may be replaced by a die-cut mechanism 40' which is die-cutting only the seal portion. As shown in FIGS. 6 and 7, the die-cut mechanism 40' includes a die-cut portion 41*a* and a platen 41*b*. The die-cut portion 41*a* includes an exchangeable blade, and can adjust a die-cutting depth. In addition, as shown in FIG. 6, the die-cut mechanism 40' may be provided on the upstream side of the inkjet head 21. One the other hand, as shown in FIG. 7, the die-cut mechanism 40' may be provided on the downstream side of the inkjet head 21.

The image analyzing means 60 is, for example, a scanner which analyzes the resolution, color hue and the like of the image formed on the test image formation sheet TS, and is connected to the recording apparatus control part and the head drive control part 70 by a signal line 71. The image analysis results of the test image formation sheet TS are fed back, and the image forming conditions for the next image are corrected. The image analysis results may also be fed back to the ultraviolet control part.

Figure 2:
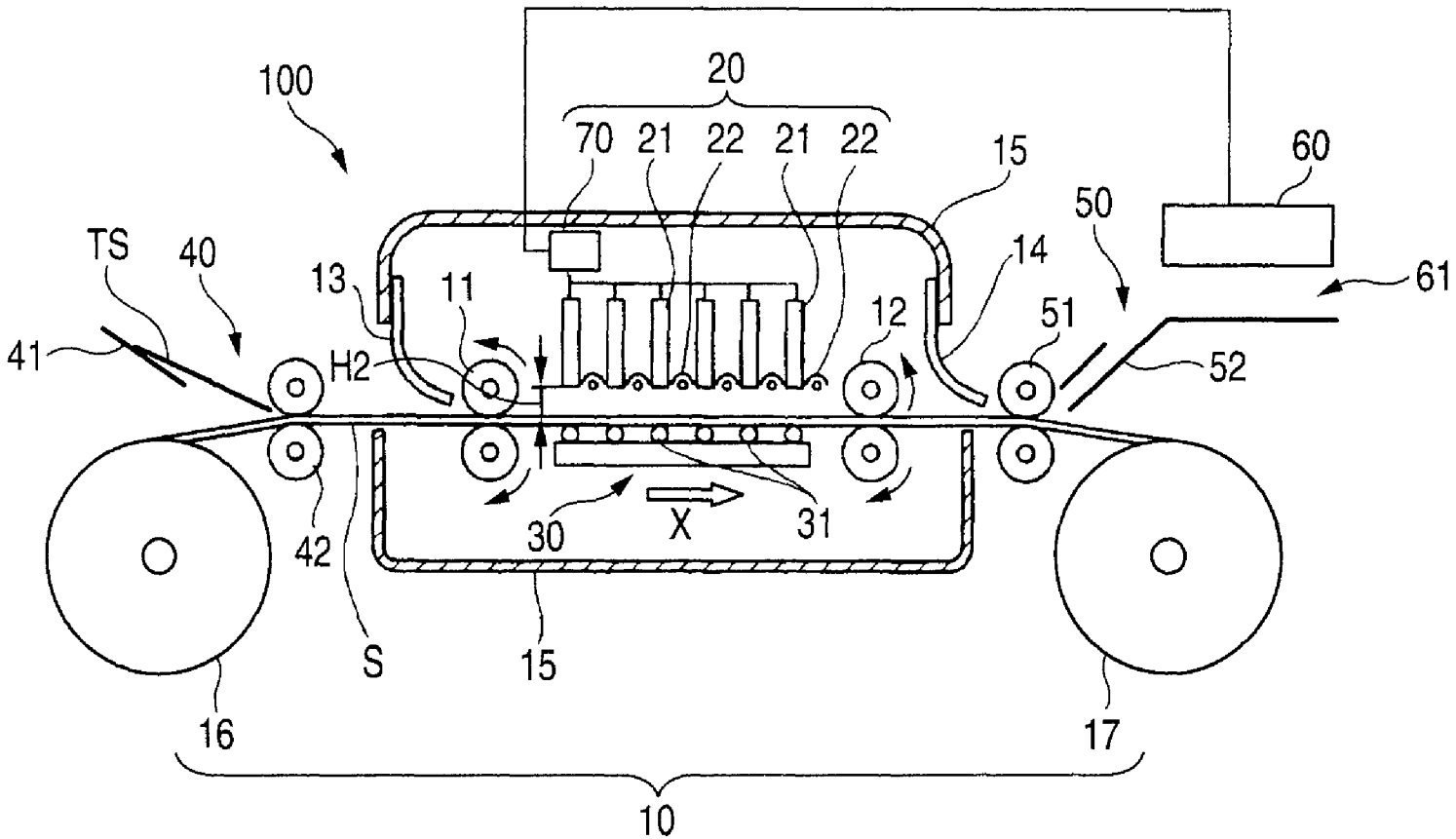
FIG. 2 is a schematic constitutional view showing the state of the recording medium-to-head distance adjusting mechanism working to control the distance between the inkjet head and the recording medium sheet for test image formation to an optimal value for ejection and the recording medium sheet for test image formation being then fed on the continuous recording medium.
Figure 3:
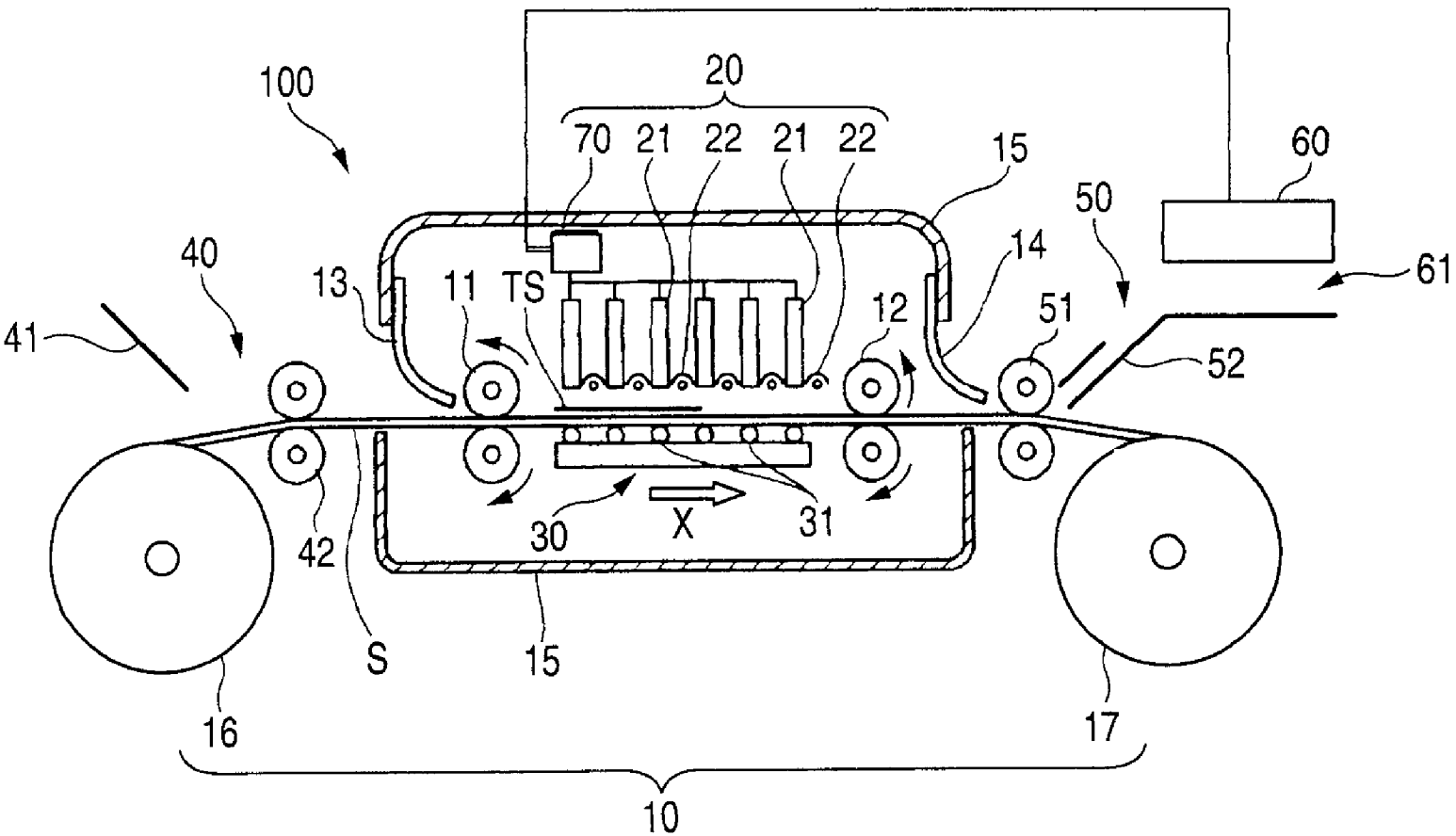
FIG. 3 is a schematic constitutional view showing the state of a test image being formed on the recording medium sheet for test image formation.
Figure 4:
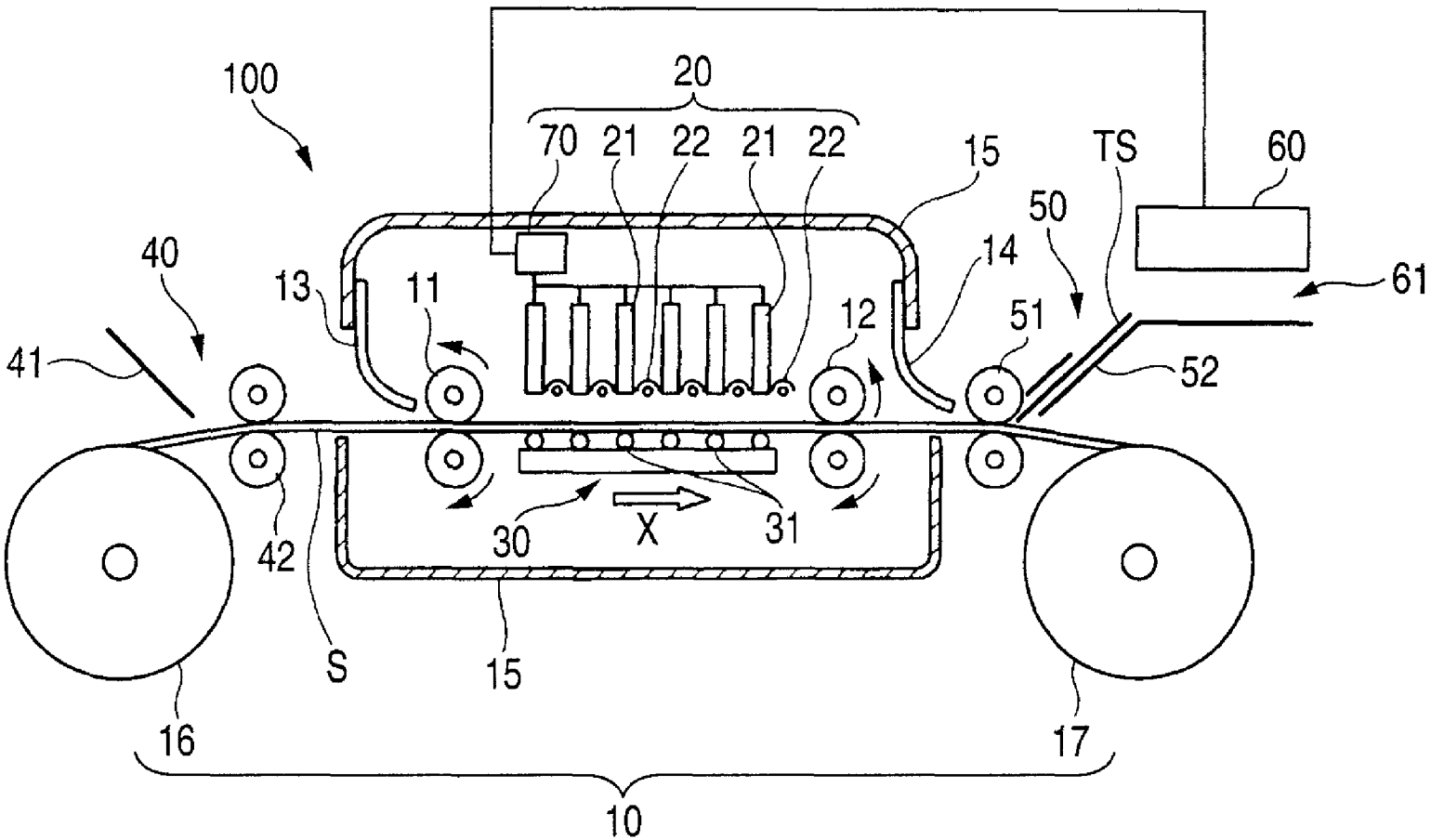
FIG. 4 is a schematic constitutional view showing the state of the recording medium sheet for test image formation being separated from the continuous recording medium and recovered.
Figure 5:
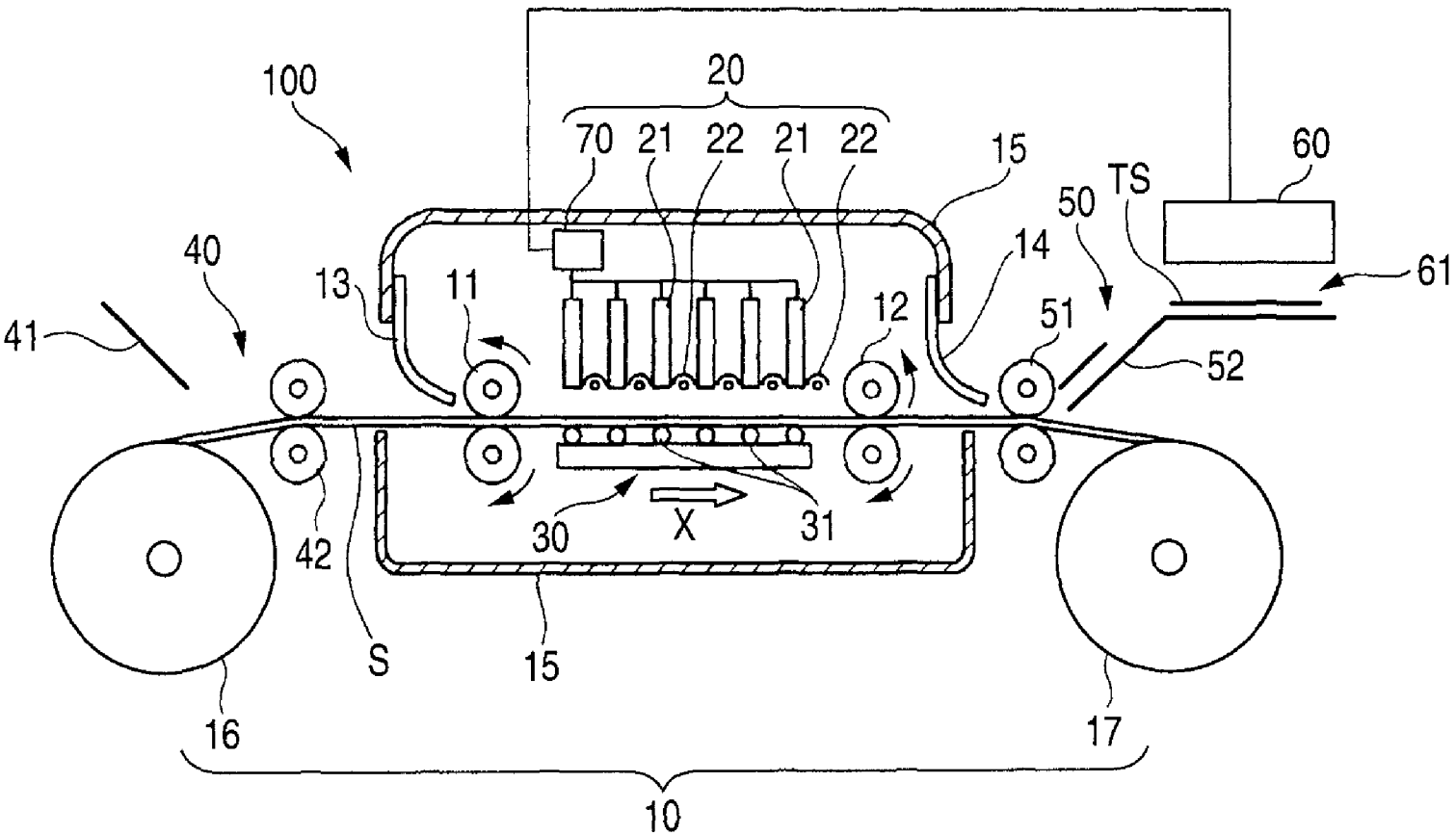
FIG. 5 is a schematic constitutional view showing the state of the test image formed on the recording medium sheet for test image formation being analyzed by the image analyzing means and the analysis results being fed back.

The mode of operation of this embodiment is described by referring to FIGS. 2 to 5. FIG. 2 is a schematic constitutional view showing the state of the recording medium-to-head distance adjusting mechanism working to control the distance between the inkjet head and the test image formation sheet to an optimal value for ejection and the test image formation sheet being then fed on the continuous recording medium; FIG. 3 is a schematic constitutional view showing the state of a test image being formed on the test image formation sheet; FIG. 4 is a schematic constitutional view showing the state of the test image formation sheet being separated from the continuous recording medium and recovered; and FIG. 5 is a schematic constitutional view showing the state of the test image formed on the test image formation sheet being analyzed by the image analyzing means and the analysis results being fed back.

In the image formation on a continuous recording medium S, which is a normal image forming step, as shown in FIG. 1, the distance H1 between the continuous recording medium S and the inkjet head 21 is adjusted to an optimal distance for ejection on the continuous recording medium S by actuating the recording medium-to-head distance adjusting mechanism 30 and moving up the conveying/holding rollers 11 and 12 and a plurality of supporting/conveying rollers 31, each connected to synchronize with the movement of the recording medium-to-head distance adjusting mechanism 30, and the continuous recording medium S is then run out from the feed roll 16 while being held between conveying/holding rollers 11 or 12 and conveyed to the image forming part 20.

The full-line type inkjet head 21 controlled by the head drive control part 70 ejects each color ink from the ejection nozzle toward the continuous recording medium S, and the ultraviolet irradiation part 22 cures the ink by applying a strong energy thereto, whereby an image is formed on the continuous recording medium S. The continuous recording medium S on which an image is formed in the image forming part 20, is further conveyed and taken up on the take-up roll 17.

In performing image evaluation of the image formed by the inkjet recording apparatus 100, which is the object of the present invention, as shown in FIG. 2, the distance H2 between the continuous recording medium S and the inkjet head 21 is widened, for example, to about 1 mm by actuating the recording medium-to-head distance adjusting mechanism 30 and moving down the conveying/holding rollers 11 and 12 and a plurality of supporting/conveying rollers 31, each connected to synchronize with the movement of the recording medium-to-head distance adjusting mechanism 30, and a space allowing for insertion of a test image formation sheet TS is thereby provided on the continuous recording medium S. By this operation, the distance between the test image formation sheet TS and the inkjet head 21 (ejection nozzle) is adjusted to an optimal value for the ejection on the test image formation sheet TS.

Subsequently, a test image formation sheet TS inserted from a stocker (not shown) stockpiling the test image formation sheet TS or manually inserted from the recording medium insertion port (not shown) is guided by the test image formation sheet-feeding means 40 using a guide plate 41 and guide rollers 42 and fed on the continuous recording medium S under conveyance.

The test image formation sheet-feeding means 40 puts the test image formation sheet TS into close contact with the recording medium S by electrostatic adsorption or by using a pressure-sensitive adhesive, so that lifting of the test image formation sheet TS from the recording medium S can be prevented at the image formation, the distance between the inkjet head 21 (ejection nozzle) and the test image formation sheet TS can be stably kept to an optimal value, and a good image can be formed.

Thereafter, as shown in FIG. 3, an ink droplet is ejected from the ejection nozzle of the full-line type inkjet head 21 toward the test image formation sheet TS while conveying the continuous recording medium S put into close contact with the test image formation sheet TS in the arrow X direction, and the ink is cured by irradiating an ultraviolet ray from the ultraviolet irradiation part 22, whereby a test image is formed on the test image formation sheet TS.

The recording medium sheet TS for test image formation, on which a test image is formed in the image forming part 20, is further conveyed and, as shown in FIG. 4, the test medium-separating means 50 is allowed to separate the recording medium sheet TS for test image formation from the recording medium S in close contact therewith and convey the sheet to the evaluation stage 61 through guiding by the guide plate 52.

As shown in FIG. 5, the test image formation sheet TS placed on the evaluation stage 61 is analyzed for the resolution, color hue and the like of the image by the image analyzing means 60. The image analysis results of the test image formation sheet TS by the image analyzing means 60 are fed back to the head drive control part 70, and the printing conditions are corrected at the next image formation, whereby an image having a constant quality can be always formed.

Examples of the printing conditions which are corrected by the image analysis results fed back include head drive conditions (e.g., drive waveform, drive voltage, drive temperature), liquid functional material fixing conditions (in the case of an energy-curable liquid functional material, e.g., light source intensity, wavelength, irradiation timing, irradiation position, shutter drive condition), the recording medium S conveying speed, drawn image data correcting conditions (e.g., e.g., screening condition, ink ejection amount correcting condition), and maintenance conditions (e.g., pressure or suction purging, exchange of ultraviolet lamp).

As for the image evaluation of the image on the test image formation sheet TS, other than the above-described automatic evaluation by a scanner, that is, the on-line evaluation, the image evaluation may also be performed off-line by recovering the test image formation sheet TS from the evaluation stage 61, manually setting the sheet in the image analyzing means 60, and reading the image. Furthermore, the test image formation sheet TS recovered from the evaluation stage 61 may be visually compared with other sample images.

Irrespective of on-line evaluation, off-line evaluation and evaluation by visual comparison, the evaluation results are fed back to the head drive control part 70 and the printing conditions are corrected at the next image formation.

The feed and image evaluation of the test image formation sheet TS by the test medium feeding means 40 can be effected at any arbitrary timing without affecting the normal image forming operation on the recording medium S and therefore, can be performed not only periodically, for example, before start of operation, during operation or after end of operation, but also aperiodically at arbitrary timing such as at the maintenance.

In the case where a recording medium for label printing having a structure that a self-adhesive sheet coated with a pressure-sensitive adhesive on the back surface is overlaid on a release paper mount is used as the continuous recording medium S and taken up on a take-up roll through the steps of image formation, curing of ink, die-cutting and separation/removal of unnecessary portions, the sample image can be recovered after the die-cutting step and subjected to image evaluation.

As described above, according to the inkjet recording apparatus 100 of this embodiment, conveying means 10 for conveying the recording medium S at the ejection position of the inkjet head 21, test image formation sheet-feeding means 40 for contact-feeding a test image formation sheet TS on the recording medium S in the upstream of the ejection position, and test image formation sheet-separating means 50 for separating the test image formation sheet TS from the recording medium S in the downstream of the ejection position are provided, so that a test image can be formed on a test image formation sheet TS fed on a recording medium S by the test image formation sheet-feeding means 40 and the test image formation sheet TS having formed thereon the test image can be separated from the recording medium S by the test image formation sheet-separating means 50. By virtue of this construction, the test image formation sheet TS alone can be easily taken out separately from the recording medium S on which a normal image is formed, and subjected to image evaluation, and an image having a constant quality can be always formed by performing the image evaluation without affecting the image forming operation on the recording medium S.

Also, the conveying means 10 comprises a recording medium-to-head distance adjusting mechanism 30 and moves the recording medium S to set the distance between the test image formation sheet TS and the inkjet head 21 to an optimal value for ejection, so that the distance between the test image formation sheet TS fed on the recording medium S and the inkjet head 21 can be adjusted to an optimal value for ejection and a good image can be formed. By virtue of this construction, the image evaluation can be properly performed.

Also, the image analyzing means 60 is made to scan-read and analyze the test image on the test image formation sheet TS after separation and feed back the analysis results to the image recording, so that a good image assured of a constant quality can be always formed by automatically performing the image evaluation by the image analyzing means 60 in addition to the evaluation with an eye and feeding back the evaluation results.

Also, the test image formation sheet-feeding means 40 is made to bring the test image formation sheet TS into close contact with the recording medium S by electrostatic adsorption or by using a pressure-sensitive adhesive, so that an image formation failure due to lifting of the test image formation sheet TS from the recording medium S can be prevented and a good test image can be formed.

Also, the test image formation sheet-separating means 50 is made to separate the test image formation sheet TS from the recording medium S by electrostatic adsorption or by using a self-adhesive roller 51, so that the test image formation sheet TS can be unfailingly separated from the recording medium S.

Also, the test image formation sheet-feeding means 40 is made to feed the test image formation sheet TS on the recording medium S at predetermined time intervals despite progress of the image formation, so that the test image formation sheet TS can be fed at predetermined time intervals and subjected to image evaluation without interrupting the image formation on the recording medium S and the reliability of the inkjet recording apparatus 100 can be thereby maintained.

Accordingly, an inkjet recording apparatus 100 capable of efficiently and properly performing image evaluation of an image formed on a continuous recording medium S by a full-line type inkjet head 21 can be provided.

The inkjet recording apparatus of the present invention is not limited to the above-described embodiment, and various changes, modifications and the like can be appropriately made therein.

The active energy-curable inkjet recording apparatus according to the present invention is not limited to those embodiments described above, and various changes, modifications and the like can be appropriately made therein.

The "active energy" as used in the present invention is not particularly limited as long as its irradiation can impart energy capable of generating an initiation species in the ink composition, and widely includes α-ray, γ-ray, X-ray, ultraviolet ray, visible ray, electron beam and the like. Among these, in view of curing sensitivity and easy availability of the apparatus, ultraviolet ray and electron beam are preferred, and ultraviolet ray is more preferred. Accordingly, the ink composition for use in the present invention is preferably an ink composition which can be cured by the irradiation of ultraviolet ray.

In the inkjet recording apparatus of the present invention, the peak wavelength of active energy varies depending on the absorption characteristics of the sensitizing dye in the ink composition but is suitably, for example, from 200 to 600 nm, preferably from 300 to 450 nm, more preferably from 350 to 450 nm. Also, the (a) electron transfer-type initiation system of the ink composition for use in the present invention exhibits sufficiently high sensitivity even for low-output active energy. Accordingly, the output of the active energy used as the irradiation energy is suitably, for example, 2,000 mJ/cm$^2$ or less, preferably from 10 to 2,000 mJ/cm$^2$, more preferably from 20 to 1,000 mJ/cm$^2$, still more preferably from 50 to 800 mJ/cm$^2$. Also, the active energy is suitably irradiated at an exposure surface illuminance (a maximum illuminance on the recording medium surface) of, for example, from 10 to 2,000 mW/cm$^2$, preferably from 20 to 1,000 mW/cm$^2$.

Particularly, in the inkjet recording apparatus of the present invention, the active energy is preferably irradiated from a light-emitting diode which can generate an ultraviolet ray having an emission wavelength peak of 390 to 420 nm and giving a maximum illuminance of 10 to 1,000 mW/cm$^2$ on the recording medium surface.

Also, in the inkjet recording apparatus of the present invention, the active energy suitably irradiates the ink composition ejected on a recording medium, for example, for 0.01 to 120 seconds, preferably from 0.1 to 90 seconds.

Furthermore, in the inkjet recording apparatus of the present invention, it is preferred that the ink composition is heated to a fixed temperature and the time from the landing of ink composition on a recording medium to the irradiation of active energy is set to 0.01 to 0.5 seconds, preferably from 0.02 to 0.3 seconds, more preferably from 0.03 to 0.15 seconds. By virtue of controlling the time from the landing of ink composition on a recording medium to the irradiation of active energy to such a very short time, the ink composition landed can be prevented from bleeding before curing.

For obtaining a color image by using the inkjet recording apparatus of the present invention, the colors are preferably superposed in the color value order from lower to higher. When superposed in such an order, the active energy can readily reach the ink in the lower part and this can be expected to yield good curing sensitivity, reduction of residual monomer, decrease of odor and enhancement of adhesive property. As for the irradiation of active energy, all colors may be ejected and en bloc exposed, but exposure is preferably performed every each color in view of accelerating the curing.

As described above, in the case of active energy-curable ink like the ink composition of the present invention, the ink composition ejected is preferably kept at a constant temperature and therefore, the temperature in the region from the ink supply tank to the inkjet head portion is preferably controlled by heat insulation and heating. Also, the head unit is preferably heated by thermally shielding or insulating the apparatus body so as not to receive an effect from the temperature of outer air. In order to shorten the printer start-up time necessary for heating or reduce the loss of heat energy, in combination with thermal insulation from other sites, the heat capacity of the entire heating unit is preferably made small.

As for the active energy source, a mercury lamp, a gas/solid laser and the like are principally utilized and for the ultraviolet curing-type inkjet, a mercury lamp and a metal halide lamp are widely known. Furthermore, replacement by a GaN-based semiconductor ultraviolet light-emitting device is industrially and environmentally very useful. In addition, LED (UV-LED) and LD (UV-LD) are compact, long-lived, highly efficient and low costing and are promising as a radiation source for active energy curing-type inkjet.

As described above, a light-emitting diode (LED) and a laser diode (LD) can be used as the active energy source. In particular, when an ultraviolet source is necessary, an ultraviolet LED or an ultraviolet LD can be used. For example, an ultraviolet LED of which main emission spectrum has a wavelength between 365 nm and 420 nm is commercially available from Nichia Corp. Also, when a further shorter wavelength is required, an LED capable of emitting active energy having a primary emission between 300 nm and 370 nm is disclosed in U.S. Pat. No. 6,084,250. Other ultraviolet LEDs are also available, and radiations in different ultraviolet bands may be irradiated. The active energy source for use in the present invention is preferably UV-LED, more preferably UV-LED having a peak wavelength in the region of 350 to 420 nm.

(Recording Medium)

The recording medium to which the ink composition of the present invention can be applied is not particularly limited and normal paper sheets such as non-coated paper and coated paper, and various non-absorptive resin materials and resin films shaped therefrom, which are used in so-called soft packaging, may be used. Examples of various plastic films include PET film, OPS film, OPP film, ONy film, PVC film, PE film and TAC film. Other examples of the plastic usable as the recording medium material include polycarbonate, acrylic resin, ABS, polyacetal, PVA and rubbers. Furthermore, metals and glasses may also be used as the recording medium.

In the ink composition of the present invention, when a material less causing heat shrinkage at curing is selected, excellent adhesive property is obtained between the cured ink composition and the recording medium and this is advantageous in that a high-definition image can be formed even on a film susceptible to curling or deformation due to, for example, curing shrinkage of ink or heat generation at the curing reaction, such as PET film, OPS film, OPP film, ONy film and PVC film which are thermally shrinkable.

The constituent components for use in the ink composition usable in the present invention are described below in sequence.

(Ink Composition)

The ink composition for use in the present invention is an ink composition capable of being cured by the irradiation of active energy, and examples thereof include a cationic polymerization-type ink composition, a radical polymerization-type ink composition and an aqueous ink composition. These compositions are described in detail below.

(Cationic Polymerization-Type Ink Composition)

The cationic polymerization-type ink composition contains (a) a cationic polymerizable compound and (b) a compound capable of generating an acid upon irradiation with active energy and if desired, may further contain a colorant, an ultraviolet absorbent, a sensitizer, an antioxidant, a discoloration inhibitor, electrically conducting salts, a solvent, a polymer compound, a surfactant and the like.

The constituent components used in the cationic polymerization-type ink composition are described below in sequence.

(a) (Cationic Polymerizable Compound)

The (a) cationic polymerizable compound for use in the present invention is not particularly limited as long as it is a compound capable of being cured by causing a polymerization reaction using an acid generated from the (b) compound capable of generating an acid upon irradiation with active energy, and various known cationic polymerizable monomers known as a photo-cationic polymerizable monomer may be used. Examples of the cationic polymerizable monomer include epoxy compounds, vinyl ether compounds and oxetane compounds described in JP-A-6-9714, JP-A-2001-31892, JP-A-2001-40068, JP-A-2001-55507, JP-A-2001-310938, JP-A-2001-310937 and JP-A-2001-220526.

Examples of the epoxy compound include an aromatic epoxide, an alicyclic epoxide and an aliphatic epoxide.

The aromatic epoxide includes a di- or polyglycidyl ether produced by the reaction of a polyhydric phenol having at least one aromatic nucleus or an alkylene oxide adduct thereof with epichlorohydrin. Examples thereof include a di- or polyglycidyl ether of bisphenol A or an alkylene oxide adduct thereof, a di- or polyglycidyl ether of hydrogenated bisphenol A or an alkylene oxide adduct thereof, and a novolak-type epoxy resin. Examples of the alkylene oxide include an ethylene oxide and a propylene oxide.

As for the alicyclic epoxide, a cyclohexene oxide- or cyclopentene oxide-containing compound obtained by epoxidizing a compound having at least one cycloalkene ring such as cyclohexene or cyclopentene ring with an appropriate oxidizing agent such as hydrogen peroxide and peracid is preferred.

Examples of the aliphatic epoxide include a di- or polyglycidyl ether of an aliphatic polyhydric alcohol or an alkylene oxide adduct thereof. Representative examples thereof include a diglycidyl ether of an alkylene glycol, such as diglycidyl ether of ethylene glycol, diglycidyl ether of propylene glycol, and diglycidyl ether of 1,6-hexanediol; a polyglycidyl ether of a polyhydric alcohol, such as di- or triglycidyl ether of glycerin or an alkylene oxide adduct thereof; and a diglycidyl ether of a polyalkylene glycol, as represented by a diglycidyl ether of a polyethylene glycol or an alkylene oxide adduct thereof, and a diglycidyl ether of a polypropylene glycol or an alkylene oxide adduct thereof. Here, examples of the alkylene oxide include an ethylene oxide and a propylene oxide.

The epoxy compound may be monofunctional or polyfunctional.

Examples of the monofunctional epoxy compound which can be used in the present invention include phenyl glycidyl ether, p-tert-butylphenyl glycidyl ether, butyl glycidyl ether, 2-ethylhexyl glycidyl ether, allyl glycidyl ether, 1,2-butylene oxide, 1,3-butadiene monoxide, 1,2-epoxydodecane, epichlorohydrin, 1,2-epoxydecane, styrene oxide, cyclohexene oxide, 3-methacryloyloxymethylcyclohexene oxide, 3-acryloyloxymethylcyclohexene oxide and 3-vinylcyclohexene oxide.

Examples of the polyfunctional epoxy compound include bisphenol A diglycidyl ether, bisphenol F diglycidyl ether, bisphenol S diglycidyl ether, brominated bisphenol A diglycidyl ether, brominated bisphenol F diglycidyl ether, brominated bisphenol S diglycidyl ether, epoxy novolak resin, hydrogenated bisphenol A diglycidyl ether, hydrogenated bisphenol F diglycidyl ether, hydrogenated bisphenol S diglycidyl ether, 3,4-epoxycyclohexylmethyl-3',4'-epoxycyclohexane carboxylate, 2-(3,4-epoxy-cyclohexyl-5,5-spiro-3,4-epoxy)cyclohexane-meta-dioxane, bis(3,4-epoxycyclohexylmethyl) adipate, vinylcyclohexene oxide, 4-vinylepoxycyclohexane, bis(3,4-epoxy-6-methyl-cyclohexylmethyl)adipate, 3,4-epoxy-6-methylcyclohexyl-3',4'-epoxy-6'-methylcyclohexane carboxylate, methylenebis(3,4-epoxycyclohexane), dicyclopentadiene diepoxide, di(3,4-epoxycyclohexylmethyl)ether of ethylene glycol, ethylenebis(3,4-epoxycyclohexane carboxylate), dioctyl epoxyhexahydrophthalate, di-2-ethylhexyl epoxyhexahydrophthalate, 1,4-butanediol diglycidyl ether, 1,6-hexanediol diglycidyl ether, glycerin triglycidyl ether, trimethylolpropane triglycidyl ether, polyethylene glycol diglycidyl ether, polypropylene glycol diglycidyl ethers, 1,1,3-tetradecadiene dioxide, limonene dioxide, 1,2,7,8-diepoxyoctane and 1,2,5,6-diepoxycyclooctane.

Among these epoxy compounds, an aromatic epoxide and an alicyclic epoxide are preferred in view of excellent curing rate, and an alicyclic epoxide is more preferred.

Examples of the vinyl ether compound include a di- or trivinyl ether compound such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether and trimethylolpropane trivinyl ether; and a monovinyl ether compound such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-O-propylene carbonate, dodecyl vinyl ether, diethylene glycol monovinyl ether and octadecyl vinyl ether.

The vinyl ether compound may be monofunctional or polyfunctional.

Specifically, examples of the monofunctional vinyl ether include methyl vinyl ether, ethyl vinyl ether, propyl vinyl ether, n-butyl vinyl ether, tert-butyl vinyl ether, 2-ethylhexyl vinyl ether, n-nonyl vinyl ether, lauryl vinyl ether, cyclohexyl vinyl ether, cyclohexylmethyl vinyl ether, 4-methylcyclohexylmethyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethylcyclohexylmethyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether and phenoxypolyethylene glycol vinyl ether.

Examples of the polyfunctional vinyl ether include divinyl ethers such as ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ether and bisphenol F alkylene oxide divinyl ether; and polyfunctional vinyl ethers such as trimethylolethane trivinyl ether, trimethylolpropane trivinyl ether, ditrimethylolpropane tetravinyl ether, glycerin trivinyl ether, pentaerythritol tetravinyl ether, dipentaerythritol pentavinyl ether, dipentaerythritol hexavinyl ether, ethylene oxide-added trimethylolpropane trivinyl ether, propylene oxide-added trimethylolpropane trivinyl ether, ethylene oxide-added ditrimethylolpropane tetravinyl ether, propylene oxide-added ditrimethylolpropane tetravinyl ether, ethylene oxide-added pentaerythritol tetravinyl ether, propylene oxide-added pentaerythritol tetravinyl ether, ethylene oxide-added dipentaerythritol hexavinyl ether and propylene oxide-added dipentaerythritol hexavinyl ether.

As for the vinyl ether compound, a di- or trivinyl ether compound is preferred in view of curing property, adhesion to recording medium, surface hardness of image formed, or the like, and a divinyl ether compound is more preferred.

The oxetane compound as referred to in the present invention indicates a compound having an oxetane ring, and known oxetane compounds described, for example, in JP-A-2001-220526, JP-A-2001-310937 and JP-A-2003-341217 may be arbitrarily selected and used.

The compound having an oxetane ring, which can be used in the ink composition of the present invention, is preferably a compound having from one to four oxetane rings in the structure thereof. When such a compound is used, the viscosity of the ink composition can be easily maintained in the range allowing for good handling, and high adhesion can be obtained between the ink composition after curing and the recording medium.

Such a compound having an oxetane ring is described in detail in paragraphs [0021] to [0084] of JP-A-2003-341217, and compounds described therein can be suitably used also in the present invention.

Out of the oxetane compounds for use in the present invention, a compound having one oxetane ring is preferably used in view of viscosity and tackiness of the ink composition.

In the ink composition of the present invention, one of these cationic polymerizable compounds may be used alone, or two or more species thereof may be used in combination, but from the standpoint of effectively controlling the shrinkage on curing the ink, at least one compound selected from oxetane compounds and epoxy compounds is preferably used in combination with a vinyl ether compound.

The content of the (a) cationic polymerizable compound in the ink composition is suitably from 10 to 95 mass %, preferably from 30 to 90 mass %, more preferably from 50 to 85 mass %, based on the entire solid content of the composition.

(b) (Compound Capable of Generating an Acid upon Irradiation with Active Energy)

The ink composition of the present invention contains a compound capable of generating an acid upon irradiation with active energy (hereinafter appropriately referred to as a "photoacid generator").

The photoacid generator which can be used in the present invention may be appropriately selected from compounds capable of generating an acid upon irradiation with light (ultraviolet ray or far ultraviolet ray of 400 to 200 nm, preferably g-ray, h-ray, i-ray or KrF excimer laser light), ArF excimer laser light, electron beam, X-ray, molecular beam or ion beam, which are used in a photo-cationic polymerization photoinitiator, a photo-radical polymerization photoinitiator, a photo-decolorizing agent for coloring matters, a photo-discoloring agent, a micro resist or the like.

Examples of such a photoacid generator include an onium salt which decomposes upon irradiation with active energy to generate an acid, such as diazonium salt, ammonium salt, phosphonium salt, iodonium salt, sulfonium salt, selenonium salt and arsonium salt; an organic halogen compound; an organic metal/organic halide; an o-nitrobenzyl type protective group-containing photoacid generator; a compound capable of undergoing photodecomposition to generate a sulfonic acid, as represented by imino sulfonate; a disulfone compound; a diazoketosulfone; and a diazodisulfone compound.

Furthermore, for example, oxazole derivatives and s-triazine derivatives described in paragraphs [0029] to [0030] of JP-A-2002-122994 may also be suitably used as the photoacid generator. In addition, onium salt compounds and sulfonate-based compounds described in paragraphs [0037] to [0063] of JP-A-2002-122994 may also be suitably used as the photoacid generator in the present invention.

As for the (b) photoacid generator, one species may be used alone or two or more species may be used in combination.

The content of the (b) photoacid generator in the ink composition is preferably from 0.1 to 20 mass %, more preferably from 0.5 to 10 mass %, still more preferably from 1 to 7 mass %, based on the entire solid content of the ink composition.

(Colorant)

The ink composition of the present invention can form a visible image by adding thereto a colorant. For example, in the case of forming an image region of a lithographic printing plate, a colorant need not be necessarily added, but in view of suitability for plate inspection of the obtained lithographic printing plate, use of a colorant is also preferred.

The colorant which can be used here is not particularly limited, and various known coloring materials (pigment, dye) may be appropriately selected and used according to the usage. For example, in the case of forming an image with excellent weather resistance, a pigment is preferred. As for the dye, both a water-soluble dye and an oil-soluble dye may be used, but an oil-soluble dye is preferred.

(Pigment)

The pigment which is preferably used in the present invention is described below.

The pigment is not particularly limited and, for example, all organic and inorganic pigments generally available on the market, those obtained by dispersing a pigment in a dispersion medium such as insoluble resin, and those obtained by grafting a resin to the pigment surface may be used. In addition, those obtained by, for example, dyeing a resin particle with a dye may also be used.

Examples of such a pigment include pigments described in Seishiro Ito (compiler), *Ganryo No Jiten* (*Pigment Dictionary*), published in 2000, W. Herbst and K. Hunger, *Industrial Organic Pigments*, JP-A-2002-12607, JP-A-2002-188025, JP-A-2003-26978 and JP-A-2003-342503.

Specific examples of the organic and inorganic pigments which can be used in the present invention are as follows. Examples of the pigment which provides a yellow color include a monoazo pigment such as C.I. Pigment Yellow 1 (e.g., Fast Yellow G) and C.I. Pigment Yellow 74; a disazo pigment such as C.I. Pigment Yellow 12 (e.g., Disazo Yellow AAA) and C.I. Pigment Yellow 17; anon-benzidine-based azo pigment such as C.I. Pigment Yellow 180; an azo lake pigment such as C.I. Pigment Yellow 100 (e.g., Tartrazine Yellow Lake); a condensed azo pigment such as C.I. Pigment Yellow 95 (e.g., Condensed Azo Yellow GR); an acidic dye lake pigment such as C.I. Pigment Yellow 115 (e.g., Quinoline Yellow Lake); a basic dye lake pigment such as C.I. Pigment Yellow 18 (e.g., Thioflavine Lake); an anthraquinone-based pigment such as Flavanthrone Yellow (Y-24); an isoindolinone pigment such as Isoindolinone Yellow 3RLT (Y-110); a quinophthalone pigment such as Quinophthalone Yellow (Y-138); an isoindoline pigment such as Isoindoline Yellow (Y-139); a nitroso pigment such as C.I. Pigment Yellow 153 (e.g., Nickel Nitroso Yellow); and a metal complex salt azomethine pigment such as C.I. Pigment Yellow 117 (e.g., Copper Azomethine Yellow).

Examples of the pigment which provides a red or magenta color include a monoazo-based pigment such as C.I. Pigment Red 3 (e.g., Toluidine Red); a disazo pigment such as C.I. Pigment Red 38 (e.g., Pyrazolone Red B); an azo lake pigment such as C.I. Pigment Red 53:1 (e.g., Lake Red C) and C.I. Pigment Red 57:1 (Brilliant Carmine 6B); a condensed azo pigment such as C.I. Pigment Red 144 (e.g., Condensed Azo Red BR); an acidic dye lake pigment such as C.I. Pigment Red 174 (e.g., Phloxine B Lake); a basic dye lake pigment such as C.I. Pigment Red 81 (e.g., Rhodamine 6G' Lake); an anthraquinone-based pigment such as C.I. Pigment Red 177 (e.g., Dianthraquinonyl Red); a thioindigo pigment such as C.I. Pigment Red 88 (e.g., Thioindigo Bordeaux); a perinone pigment such as C.I. Pigment Red 194 (e.g., Perinone Red); a perylene pigment such as C.I. Pigment Red 149 (e.g., Perylene Scarlet); a quinacridone pigment such as C. I. Pigment Violet 19 (unsubstituted quinacridone) and C.I. Pigment Red 122 (e.g., Quinacridone Magenta); an isoindolinone pigment such as C.I. Pigment Red 180 (e.g., Isoindolinone Red 2BLT); and an alizarin lake pigment such as C.I. Pigment Red 83 (e.g., Madder Lake).

Examples of the pigment which provides a blue or cyan color include a disazo-based pigment such as C.I. Pigment Blue 25 (e.g., Dianisidine Blue); a phthalocyanine pigment such as C.I. Pigment Blue 15 (e.g., Phthalocyanine Blue); an acidic dye lake pigment such as C.I. Pigment Blue 24 (e.g., Peacock Blue Lake); a basic dye lake pigment such as C.I. Pigment Blue 1 (e.g., Victoria Pure Blue BO Lake); an anthraquinone-based pigment such as C.I. Pigment Blue 60 (e.g., Indanthrone Blue); and an alkali blue pigment such as C.I. Pigment Blue 18 (Alkali Blue V-5:1).

Examples of the pigment which provides a green color include a phthalocyanine pigment such as C.I. Pigment Green 7 (Phthalocyanine Green) and C.I. Pigment Green 36 (Phthalocyanine Green); and an azo metal complex pigment such as C.I. Pigment Green 8 (Nitroso Green).

Examples of the pigment which provides an orange color include an isoindoline-based pigment such as C.I. Pigment Orange 66 (Isoindoline Orange); and an anthraquinone-based pigment such as C. I. Pigment Orange 51 (Dichloropyranthrone Orange).

Examples of the pigment which provides a black color include carbon black, titanium black and aniline black.

Specific examples of the white pigment which can be used include basic lead carbonate ($2PbCO_3Pb(OH)_2$, so-called "silver white"), zinc oxide (ZnO, so-called "zinc white"), titanium oxide ($TiO_2$, so-called "titanium white"), strontium titanate ($SrTiO_3$, so-called "titanium strontium white").

Here, titanium oxide has a low specific gravity and a high refractive index and is chemically and physically stable as compared with other white pigments and therefore, this pigment ensures that the masking power and coloring power as a pigment are high and the durability against acid, alkali and other environments is excellent. Because of this, titanium oxide is preferably used as the white pigment. As a matter of course, other white pigments (may also be a white pigment other than those described above) may be used, if desired.

The pigment may be dispersed by using a dispersing device such as ball mill, sand mill, attritor, roll mill, jet mill, homogenizer, paint shaker, kneader, agitator, Henschel mixer, colloid mill, ultrasonic homogenizer, pearl mill and wet jet mill.

When dispersing the pigment, a dispersant may also be added. Examples of the dispersant include a hydroxyl group-containing carboxylic acid ester, a salt of long-chain polyaminoamide with high molecular weight acid ester, a salt of high molecular weight polycarboxylic acid, a high molecular weight unsaturated acid ester, a polymer copolymerization product, a modified polyacrylate, an aliphatic polyvalent carboxylic acid, a naphthalenesulfonic acid formalin condensate, a polyoxyethylene alkylphosphoric ester and a pigment derivative. A commercially available polymer dispersant such as Solsperse Series of Zeneca Ltd. may also be preferably used.

In addition, a synergist according to various pigments may be used as a dispersion aid. The dispersant or dispersion aid is preferably added in an amount of 1 to 50 parts by mass per 100 parts by mass of the pigment.

In the ink composition, a solvent may be added as a dispersion medium for various components such as pigment, or the (a) cationic polymerizable compound which is a low molecular weight component may be used as a dispersion medium without using a solvent. However, since the ink composition of the present invention is an active energy-curable ink and the ink is applied onto a recording medium and then cured, the ink composition is preferably solvent-free. This is because when a solvent remains in the cured ink image, the solvent resistance may deteriorate or the residual solvent may cause a problem of VOC (volatile organic compound). From such a standpoint, the (a) cationic polymerizable compound is preferably used as the dispersion medium. Above all, in view of dispersion suitability or enhancement of handling property of the ink composition, a cationic polymerizable monomer having a lowest viscosity is preferably selected.

The average particle diameter of the pigment is preferably from 0.02 to 4 μm, more preferably from 0.02 to 2 μm, still more preferably from 0.02 to 1.0 μm.

The pigment, dispersant, dispersion medium and dispersion or filtration conditions are selected or set so that the pigment particle can have an average particle diameter in the above-described preferred range. By this control of the particle diameter, clogging of the head nozzle can be suppressed and the storage stability, transparency and curing sensitivity of ink can be maintained.

(Dye)

The dye for use in the present invention is preferably an oil-soluble dye. Specifically, the oil-soluble dye means a dye having a solubility in water at 25° C. (mass of the coloring matter dissolved in 100 g of water) of 1 g or less. The solubility is preferably 0.5 g or less, more preferably 0.1 g or less. Accordingly, a so-called water-insoluble oil-soluble dye is preferably used.

As regards the dye for use in the present invention, it is also preferred to introduce an oil-solubilizing group into the mother nucleus of the above-described dye for the purpose of dissolving a necessary amount of dye in the ink composition.

Examples of the oil-solubilizing group include a long-chain or branched alkyl group, a long-chain or branched alkoxy group, a long-chain or branched alkylthio group, a long-chain or branched alkylsulfonyl group, a long-chain or branched acyloxy group, a long-chain or branched alkoxycarbonyl group, a long-chain or branched acyl group, a long-chain or branched acylamino group, a long-chain or branched alkylsulfonylamino group, a long-chain or branched alkylaminosulfonyl group; and an aryl group, an aryloxy group, an aryloxycarbonyl group, an arylcarbonyloxy group, an arylaminocarbonyl group, an arylaminosulfonyl group and an arylsulfonylamino group, each containing the above-described long-chain or branched substituent.

Furthermore, the dye may be obtained from a water-soluble dye having a carboxyl acid or a sulfonic acid through conversion into an oil-solubilizing group, that is, an alkoxycarbonyl group, an aryloxycarbonyl group, an alkylaminosulfonyl group or an arylaminosulfonyl group, by using a long-chain or branched alcohol, an amine, a phenol or an aniline derivative.

The oil-soluble dye preferably has a melting point of 200° C. or less, more preferably 150° C. or less, still more preferably 100° C. By using an oil-soluble dye having a low melting point, crystal precipitation of the coloring matter in the ink composition is suppressed and the ink composition comes to have good storage stability.

Furthermore, for the purpose of improving resistance against fading, particularly against an oxidative substance such as ozone, or enhancing the curing property, the oxidation potential is preferably noble (high). For this reason, the oil-soluble dye for use in the present invention preferably has an oxidation potential of 1.0 V (vs SCE) or more. A higher oxidation potential is preferred, and the oxidation potential is more preferably 1.1 V (vs SCE) or more, still more preferably 1.15 V (vs SCE) or more.

As for the dye of yellow color, compounds having a structure represented by formula (Y-I) of JP-A-2004-250483 are preferred.

Dyes represented by formulae (Y-II) to (Y-IV) described in paragraph [0034] of JP-A-2004-250483 are more preferred. Specific examples thereof include compounds described in paragraphs [0060] to [0071] of JP-A-2004-250483. Incidentally, the oil-soluble dye of formula (Y-I) described in the patent publication above may be used not only for yellow ink but also for ink of any color, such as black ink and red ink.

As for the dye of magenta color, compounds having a structure represented by formula (3) or (4) described in JP-A-2002-114930 are preferred. Specific examples thereof include the compounds described in paragraphs [0054] to [0073] of JP-A-2002-114930.

Azo dyes represented by formulae (M-1) to (M-2) described in paragraphs [0084] to [0122] of JP-A-2002-121414 are more preferred, and specific examples thereof include the compounds described in paragraphs [0123] to [0132] of JP-A-2002-121414. Incidentally, the oil-soluble dyes of formulae (3), (4) and (M-1) to (M-2) described in these patent publications may be used not only for magenta ink but also for ink of any color, such as black ink and red ink.

As for the dye of cyan color, dyes represented by formulae (I) to (IV) of JP-A-2001-181547 and dyes represented by formulae (IV-1) to (IV-4) described in paragraphs [0063] to [0078] of JP-A-2002-121414 are preferred. Specific examples thereof include the compounds described in paragraphs [0052] to [0066] of JP-A-2001-181547 and the compounds described in paragraphs [0079] to [0081] of JP-A-2002-121414.

Phthalocyanine dyes represented by formulae (C-I) and (C-II) described in paragraphs [0133] to [0196] of JP-A-2002-121414 are more preferred, and the phthalocyanine dye represented by formula (C-II) is still more preferred. Specific examples thereof include the compounds described in paragraphs [0198] to [0201] of JP-A-2002-121414. Incidentally, the oil-soluble dyes of formulae (I) to (IV), (IV-1) to (IV-4), (C-I) and (C-II) may be used not only for cyan ink but also for ink of any color, such as black ink and green ink.

Such a colorant is preferably added in an amount of, in terms of the solid content, from 1 to 20 mass %, more preferably from 2 to 10 mass %, based on the ink composition.

In the ink composition of the present invention, in addition to the above-described essential components, various additives may be used in combination according to the purpose. These arbitrary components are described below.

(Ultraviolet Absorbent)

In the present invention, an ultraviolet absorbent may be used from the standpoint of giving an image enhanced in the weather resistance and prevented from fading.

Examples of the ultraviolet absorbent include benzotriazole-based compounds described in JP-A-58-185677, JP-A-61-190537, JP-A-2-782, JP-A-5-197075 and JP-A-9-34057; benzophenone-based compounds described in JP-A-46-2784, JP-A-5-194483 and U.S. Pat. No. 3,214,463; cinnamic acid-based compounds described in JP-B-48-30492 (the term "JP-B" as used herein means an "examined Japanese patent application"), JP-B-56-21141 and JP-A-10-88106; triazine-based compounds described in JP-A-4-298503, JP-A-8-53427, JP-A-8-239368, JP-A-10-182621 and JP-T-8-501291 (the term (the term "JP-T" as used herein means a "published Japanese translation of a PCT patent application"); compounds described in *Research Disclosure*, No. 24239; and compounds capable of absorbing ultraviolet ray to emit fluorescence, so-called fluorescent brightening agent, as represented by a stilbene-based compound and a benzoxazole-based compound.

The amount of the ultraviolet absorbent added is appropriately selected according to the purpose but is generally on the order of 0.5 to 15 mass % in terms of the solid content.

(Sensitizer)

In the ink composition of the present invention, if desired, a sensitizer may be added for the purpose of enhancing the acid generation efficiency of the photoacid generator and shifting the photosensitive wavelength to a long wavelength side. The sensitizer may be any sensitizer as long as it can sensitize the photoacid generator by an electron or energy transfer mechanism. Preferred examples thereof include an aromatic polycondensed ring compound such as anthracene, 9,10-dialkoxyanthracene, pyrene and perylene; an aromatic ketone compound such as acetophenone, benzophenone, thioxanthone and Michler's ketone; and a heterocyclic compound such as phenothiazine and N-aryloxazolidinone. The amount of the sensitizer added is appropriately selected according to the purpose but is generally from 0.01 to 1 mol %, preferably from 0.1 to 0.5 mol %, based on the photoacid generator.

(Antioxidant)

An antioxidant may be added for the purpose of enhancing the stability of the ink composition. Examples of the antioxidant include those described in EP-A-223739, EP-A-309401, EP-A-309402, EP-A-310551, EP-A-310552, EP-A-459-416, German Unexamined Patent Publication No. 3435443, JP-A-54-48535, JP-A-62-262047, JP-A-63-113536, JP-A-63-163351, JP-A-2-262654, JP-A-2-71262, JP-A-3-121449, JP-A-5-61166, JP-A-5-119449, and U.S. Pat. Nos. 4,814,262 and 4,980,275.

The amount of the antioxidant added is appropriately selected according to the purpose but is generally on the order of 0.1 to 8 mass % in terms of the solid content.

(Anti-Fading Agent)

In the ink composition of the present invention, various organic or metal complex-based anti-fading agents may be used. Examples of the organic anti-fading agent include hydroquinones, alkoxyphenols, dialkoxyphenols, phenols, anilines, amines, indanes, chromans, alkoxyanilines and heterocyclic compounds. Examples of the metal complex-based anti-fading agent include a nickel complex and a zinc complex, and specifically, there may be used the compounds described in patents cited in *Research Disclosure*, No. 17643, No. VII, Items I to J. ibid., No. 15162, ibid., No. 18716, page 650, left column, ibid., No. 36544, page 527, ibid., No. 307105, page 872, and ibid., No. 15162; and the compounds included in formulae of representative compounds and in examples of the compounds describe on JP-A-62-215272, pp. 127-137.

The amount of the anti-fading agent added is appropriately selected according to the purpose but is generally on the order of 0.1 to 8 mass % in terms of the solid content.

(Electrically Conducting Salts)

In the ink composition of the present invention, electrically conducting salts such as potassium thiocyanate, lithium nitrate, ammonium thiocyanate and dimethylamine hydrochloride may be added for the purpose of controlling the ejection physical property.

(Solvent)

In the ink composition of the present invention, addition of an organic solvent in an extremely small amount is also effective for the purpose of improving the adhesion to a recording medium.

Examples of the solvent include a ketone-based solvent such as acetone, methyl ethyl ketone and diethyl ketone; an alcohol-based solvent such as methanol, ethanol, 2-propanol, 1-propanol, 1-butanol and tert-butanol; a chlorine-based solvent such as chloroform and methylene chloride; an aromatic solvent such as benzene and toluene; an ester-based solvent such as ethyl acetate, butyl acetate and isopropyl acetate; an ether-based solvent such as diethyl ether, tetrahydrofuran and dioxane; and a glycol ether-based solvent such as ethylene glycol monomethyl ether and ethylene glycol dimethyl ether.

In this case, addition in the range of not causing a problem in the solvent resistance or VOC is effective, and this amount is preferably from 0.1 to 5 mass %, more preferably from 0.1 to 3 mass %, based on the entire ink composition.

(Polymer Compound)

In the ink composition of the present invention, various polymer compounds may be added for the purpose of adjusting the film physical properties. Examples of the polymer compound which can be used include an acryl-based polymer, a polyvinyl butyral resin, a polyurethane resin, a polyamide resin, a polyester resin, an epoxy resin, a phenol resin, a polycarbonate resin, a polyvinyl butyral resin, a polyvinyl formal resin, a shellac, a vinyl-based resin, an acryl-based resin, a rubber-based resin, waxes and other natural resins. Also, two or more species thereof may be used in combination. Among these, a vinyl-based copolymer obtainable by the copolymerization of an acryl-based monomer is preferred. In addition, as for the copolymerization composition of the polymer binder, a copolymer containing, as the structural unit, a "carboxyl group-containing monomer", an "alkyl methacrylate" or an "alkyl acrylate" is also preferably used.

(Surfactant)

In the ink composition of the present invention, a surfactant may also be added.

The surfactant includes those described in JP-A-62-173463 and JP-A-62-183457. Examples thereof include an anionic surfactant such as dialkylsulfosuccinates, alkylnaphthalenesulfonates and fatty acid salts; a nonionic surfactant such as polyoxyethylene alkyl ethers, polyoxyethylene alkylallyl ethers, acetylene glycols and polyoxyethylene-polyoxypropylene block copolymers; and a cationic surfactant such as alkylamine salts and quaternary ammonium salts. Incidentally, an organic fluoro compound may be used in place of the surfactant above. The organic fluoro compound is preferably hydrophobic. Examples of the organic fluoro compound include a fluorine-containing surfactant, an oily fluorine-containing compound (e.g., fluorine oil), a solid fluorine compound resin (e.g., tetrafluoroethylene resin), and those described in JP-B-57-9053 (columns 8 to 17) and JP-A-62-135826.

Other than these, for example, a leveling additive, a matting agent, waxes for adjusting the film physical properties, and a tackifier for improving adhesion to a recording medium such as polyolefin and PET, which does not inhibit the polymerization, may be added, if desired.

Specific examples of the tackifier include high molecular weight adhesive polymers described in JP-A-2001-49200, pp. 5-6 (for example, a copolymer comprising an ester of a (meth)acrylic acid and an alcohol containing an alkyl group having a carbon number of 1 to 20, an ester of a (meth) acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

(Radical Polymerization-Type Ink Composition)

The radical polymerization-type ink composition contains (d) a radical polymerizable compound, (e) a polymerization initiator and a colorant and, if desired, may further contain a colorant, a sensitizing dye, a co-sensitizer and the like.

The constituent components used in the radical polymerization-type ink composition are described below in sequence.

(d) (Radical Polymerizable Compound)

The radical polymerizable compound includes, for example, the following compound having an addition-polymerizable ethylenically unsaturated bond.

(Compound Having Addition-Polymerizable Ethylenically Unsaturated Bond)

Examples of the compound having an addition-polymerizable ethylenically unsaturated bond, which can be used in the ink composition of the present invention, include an ester of an unsaturated carboxylic acid (e.g., acrylic acid, methacrylic acid, itaconic acid, crotonic acid, isocrotonic acid, maleic acid) and an aliphatic polyhydric alcohol compound, and an amide of the above-described unsaturated carboxylic acid and an aliphatic polyvalent amine compound.

Specific examples of the ester monomer of an aliphatic polyhydric alcohol compound and an unsaturated carboxylic acid include the followings. Examples of the acrylic ester include ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl)ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri(acryloyloxyethyl)isocyanurate, and polyester acrylate oligomer.

Examples of the methacrylic acid ester include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy)-phenyl]dimethylmethane, and bis[p-(acryloxyethoxy)phenyl]-dimethylmethane. Examples of itaconic acid ester include ethylene glycol diitaconate, propylene glycol diitaconate, 1,3-butanediol diitaconate, 1,4-butanediol diitaconate, tetramethylene glycol diitaconate, pentaerythritol diitaconate, and sorbitol tetraitaconate.

Examples of the crotonic acid ester include ethylene glycol dicrotonate, tetramethylene glycol dicrotonate, pentaerythritol dicrotonate, and sorbitol tetradicrotonate. Examples of the isocrotonic acid ester include ethylene glycol diisocrotonate, pentaerythritol diisocrotonate and sorbitol tetraisocrotonate. Examples of the maleic acid ester include ethylene glycol dimaleate, triethylene glycol dimaleate, pentaerythritol dimaleate and sorbitol tetramaleate. In addition, a mixture of these ester monomers may also be used. Specific examples of the amide monomer of an aliphatic polyvalent amine compound and an unsaturated carboxylic acid include methylenebis-acrylamide, methylenebis-methacrylamide, 1,6-hexamethylenebis-acrylamide, 1,6-hexamethylenebis-methacrylamide, diethylene triamine trisacrylamide, xylylenebisacrylamide, and xylylenebismethacrylamide.

Other examples include a vinyl urethane compound containing two or more polymerizable vinyl groups within one molecule, which is obtained by adding a hydroxyl group-containing vinyl monomer represented by the following formula (A) to a polyisocyanate compound containing two or more isocyanate groups within one molecule, described in JP-B-48-41708. $CH_2{=}C(R)COOCH_2CH(R')OH$(A) (wherein R and R' each represents H or $CH_3$).

Still other examples include a functional acrylate or methacrylate such as urethane acrylates described in JP-A-51-37193, polyester acrylates described in JP-A-48-64183, JP-B-49-43191 and JP-B-52-30490, and epoxy acrylates obtained by reacting an epoxy resin and a (meth)acrylic acid. Furthermore, those described as a photocurable monomer or oligomer in *Journal of the Adhesion Society of Japan*, Vol. 20, No. 7, pp. 300-308 (1984) may also be used. In the present invention, these monomers can be used in a chemical form such as a prepolymer, namely, dimer, trimer or oligomer, or a mixture or copolymer thereof.

The amount of the radical polymerizable compound used is usually from 1 to 99.99%, preferably from 5 to 90.0%, more preferably from 10 to 70% ("%" as used herein indicates "mass %"), based on all components of the ink composition.

(e) (Photopolymerization Initiator)

The photopolymerization initiator for use in the radical polymerization-type ink composition of the present invention is described below.

The photopolymerization initiator as used in the present invention indicates a compound capable of undergoing a chemical change under the action of light or through interaction with the electron excited state of a sensitizing dye and thereby producing at least one species of a radical, an acid and a base.

Preferred examples of the photopolymerization initiator include (i) aromatic ketones, (ii) an aromatic onium salt compound, (iii) an organic peroxide, (iv) a hexaarylbiimidazole compound, (v) a ketoxime ester compound, (vi) a borate compound, (vii) an azinium compound, (viii) a metallocene compound, (vix) an active ester compound, and (x) a carbon-halogen bond-containing compound.

(Colorant)

A colorant the same as those described for the (c) colorant regarding the cationic polymerization-type ink composition may be utilized.

In the ink composition of the present invention, in addition to the above-described essential components, various additives may be used in combination according to the purpose. These arbitrary components are described below.

(Sensitizing Dye)

In the present invention, a sensitizing dye may be added for the purpose of improving the sensitivity of the photopolymerization initiator. Preferred examples of the sensitizing dye include those belonging to the following compounds and having an absorption wavelength in the region from 350 to 450 nm.

That is, the compounds are polynuclear aromatics (e.g., pyrene, perylene, triphenylene), xanthenes (e.g., fluorescein, eosin, erythrosin, Rhodamine B, Rose Bengale), cyanines (e.g., thiacarbocyanine, oxacarbocyanine), merocyanines (e.g., merocyanine, carbomerocyanine), thiazines (e.g., thionine, Methylene Blue, Toluidine Blue), acridines (e.g., Acridine Orange, chloroflavin, acriflavine), anthraquinones (e.g., anthraquinone), squaryliums (e.g., squarylium), and coumarins (e.g., 7-diethylamino-4-methylcoumarin).

(Co-Sensitizer)

Furthermore, in the ink of the present invention, a known compound having an activity of, for example, more enhancing the sensitivity or suppressing the polymerization inhibition by oxygen may be added as a co-sensitizer.

Examples of such a co-sensitizer include amines such as compounds described in M. R. Sander, et al., *Journal of Polymer Society*, Vol. 10, page 3173 (1972), JP-B-44-20189, JP-A-51-82102, JP-A-52-134692, JP-A-59-138205, JP-A-60-84305, JP-A-62-18537, JP-A-64-33104, and *Research Disclosure*, No. 33825. Specific examples thereof include triethanolamine, ethyl p-dimethylaminobenzoate, p-formyldimethylaniline and p-methylthiodimethylaniline.

Other examples include thiols and sulfides such as thiol compounds described in JP-A-53-702, JP-B-55-500806, and JP-A-5-142772 and disulfide compounds described in JP-A-56-75643. Specific examples thereof include 2-mercaptobenzothiazole, 2-mercaptobenzoxazole, 2-mercaptobenzimidazole, 2-mercapto-4(3H)-quinazoline and β-mercaptonaphthalene.

Still other examples include an amino acid compound (e.g., N-phenylglycine), organometallic compounds described in JP-B-48-42965 (e.g., tributyltin acetate), hydrogen donors described in JP-B-55-34414, sulfur compounds described in JP-A-6-308727 (e.g., trithian), phosphorus compounds described in JP-A-6-250387 (e.g., diethyl phosphite), and Si—H and Ge—H compounds described in Japanese Patent Application No. 6-191605.

Also, in view of enhancing the storability, a polymerization inhibitor is preferably added in an amount of 200 to 20,000 ppm. The ink for inkjet recording of the present invention is preferably ejected after heating it in the range from 40 to 80° C. and thereby decreasing the viscosity, and also for preventing head clogging due to thermal polymerization, addition of a polymerization inhibitor is preferred. Examples of the polymerization inhibitor include hydroquinone, benzoquinone, p-methoxyphenol, TEMPO, TEMPOL and cupferron Al.

(Others)

In addition, known compounds may be used as needed. For example, a surfactant, a leveling additive, a matting agent and, for adjusting the film physical properties, a polyester-based resin, a polyurethane-based resin, a vinyl-based resin, an acryl-based resin, a rubber-based resin or waxes, may be appropriately selected and used. Furthermore, in order to improve the adhesion to a recording medium such as polyolefin and PET, a tackifier which does not inhibit the polymerization is also preferably contained. Specific examples thereof include high molecular weight adhesive polymers described in JP-A-2001-49200, pp. 5-6 (for example, a copolymer comprising an ester of a (meth) acrylic acid and an alcohol containing an alkyl group having a carbon number of 1 to 20, an ester of a (meth)acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

Also, addition of an organic solvent in an extremely small amount is effective for the purpose of improving adhesion to a recording medium. In this case, addition in the range of not causing a problem in the solvent resistance or VOC is effective, and this amount is preferably from 0.1 to 5 mass %, more preferably from 0.1 to 3 mass %, based on the entire ink composition.

Furthermore, as the means for preventing reduction in the sensitivity due to light-shielding effect of the coloring material in the ink, it is also one preferred embodiment to form a radical/cation hybrid-type curing ink by combining a cationic polymerizable monomer having a long life as the polymerization initiator with a polymerization initiator.

(Aqueous Ink Composition)

The aqueous ink composition contains a polymerizable compound and a water-soluble photopolymerization initiator capable of generating a radical under the action of active energy and if desired, may further contain a coloring material and the like.

(Polymerizable Compound)

As for the polymerizable compound contained in the aqueous ink composition of the present invention, a polymerizable compound contained in known aqueous ink compositions may be used.

In the aqueous ink composition, a reactive material may be added so as to optimize the formulation by taking into account end user characteristics such as curing rate, adhesion and flexibility. For example, a (meth)acrylate (namely, acrylate and/or methacrylate) monomer or oligomer, an epoxide and an oxetane are used as such a reactive material.

Examples of the acrylate monomer include a phenoxyethyl acrylate, an octyldecyl acrylate, a tetrahydrofuryl acrylate, an isobornyl acrylate, a hexanediol diacrylate, a trimethylolpropane triacrylate, a pentaerythritol triacrylate, a polyethylene glycol diacrylate (e.g., tetraethylene glycol diacrylate), a dipropylene glycol diacrylate, a tri(propylene glycol) triacrylate, a neopentyl glycol diacrylate, a bis(pentaerythritol) hexaacrylate, an acrylate of ethoxylated or propoxylated glycol and polyol (e.g., propoxylated neopentyl glycol diacrylate, ethoxylated trimethylolpropane triacrylate), and a mixture thereof.

Examples of the acrylate oligomer include an ethoxylated polyethylene glycol, an ethoxylated trimethylolpropane acrylate, a polyether acrylate including its ethoxylated product, and a urethane acrylate oligomer.

Examples of the methacrylate include a hexanediol dimethacrylate, a trimethylolpropane trimethacrylate, a triethylene glycol dimethacrylate, a diethylene glycol dimethacrylate, an ethylene glycol dimethacrylate, a 1,4-butanediol dimethacrylate, and a mixture thereof.

The amount of the oligomer added is preferably from 1 to 80 wt %, more preferably from 1 to 10 wt %, based on the entire weight of the ink composition.

(Water-Soluble Photopolymerization Initiator Capable of Producing a Radical Under the Action of Active Energy)

The polymerization initiator which can be used in the ink composition of the present invention is described below. As one example, a photopolymerization initiator up to a wavelength of around 400 nm may be used. Examples of such a photopolymerization initiator include photopolymerization initiators represented by the following formulae, which are a substance having functionality in a long wavelength region, namely, sensitivity of producing a radical when irradiated with ultraviolet rays (hereinafter simply referred to as a "TX system"). In the present invention, particularly, a photopolymerization initiator appropriately selected from these is preferably used.

TX-1:

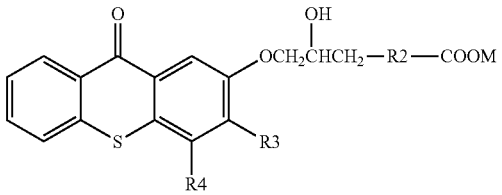

TX-2:

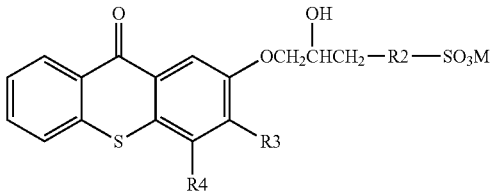

TX-3:

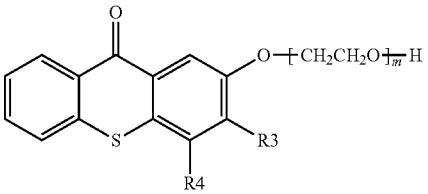

In formulae TX-1 to TX-3, R2 represents $—(CH_2)_x—$ (wherein x is 0 or 1), $—O—(CH_2)_y—$ (wherein y is 1 or 2), or a substituted or unsubstituted phenylene group. When R2 is a phenylene group, at least one of the hydrogen atoms in the benzene ring may be substituted by one group or atom or two or more groups or atoms selected from, for example, a carboxyl group or a salt thereof, a sulfonic acid or a salt thereof, a linear or branched alkyl group having a carbon number of 1 to 4, a halogen atom (e.g., fluorine, chlorine, bromine), an alkoxyl group having a carbon number of 1 to 4, and an aryloxy group such as phenoxy group. M represents a hydrogen atom or an alkali metal (e.g., Li, Na, K). R3 and R4 each independently represents a hydrogen atom or a substituted or unsubstituted alkyl group. Examples of the alkyl group include a linear or branched alkyl group having a carbon number of approximately from 1 to 10, particularly, a carbon number of approximately from 1 to 3. Examples of the substituent for this alkyl group include a halogen atom (e.g., fluorine, chlorine, bromine), a hydroxyl group, and an alkoxyl group (having a carbon number of approximately from 1 to 3). m represents an integer of 1 to 10.

In the present invention, a water-soluble derivative of a photopolymerization initiator, Irgacure 2959 (trade name, produced by Ciba Specialty Chemicals), represented by the following formula (hereinafter simply referred to as an "IC system") may be used. Specifically, IC-1 to IC-3 of the following formulae may be used.

Formula:

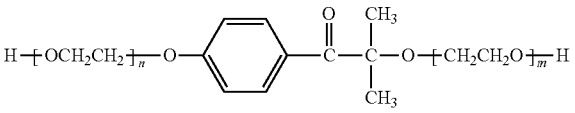

($n$: 2 to 5, $m$: 0 to 5)

IC-1:

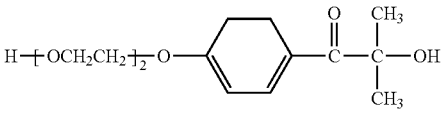

IC-2:

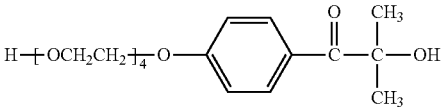

IC-3:

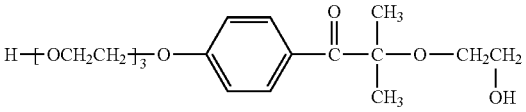

(Formulation for Clear Ink)

By using the water-soluble polymerizable compound in the form of a transparent aqueous ink without incorporating the above-described coloring material, a clear ink can be prepared. In particular, when the ink is prepared to have inkjet recording property, an aqueous photocuring-type clear ink for inkjet recording is obtained. This ink contains no coloring material and therefore, a clear film can be obtained by using the ink. Examples of the usage of the coloring material-free clear ink include use as an undercoat for imparting suitability for image printing to a recording material, and use as an overcoat for protecting the surface of an image formed by a normal ink or further imparting decoration, gloss or the like. In the clear ink, a colorless pigment, a fine particle or the like not for the purpose of coloration may be incorporated by dispersion according to the usage above. By this addition, various properties such as image quality, fastness and processability (handling property) of a printed matter can be enhanced in both cases of undercoat and overcoat.

As for the formulation conditions in such application to a clear ink, the ink is preferably prepared to contain a water-soluble polymerizable compound as the main component of the ink in a proportion of 10 to 85% and a photopolymerization initiator (for example, an ultraviolet polymerization catalyst) in an amount of 1 to 10 parts by mass per 100 parts by mass of the water-soluble polymerizable compound and at the same time, contain a photopolymerization initiator in an amount of at least 0.5 parts per 100 parts of the ink.

(Material Construction in Coloring Material-Containing Ink)

In the case of using the water-soluble polymerizable compound for a coloring material-containing ink, the concentrations of the polymerization initiator and polymerizable substance in the ink are preferably adjusted according to the absorption characteristics of the coloring material contained. As described above, the blending amount is set such that the amount of water or solvent is, on the mass basis, from 40 to 90%, preferably from 60 to 75%. Also, the content of the polymerizable compound in the ink is set to, on the mass basis, from 1 to 30%, preferably from 5 to 20%, based on the entire amount of the ink. The amount of the polymerization initiator depends on the content of the polymerizable compound but is generally, on the mass basis, from 0.1 to 7%, preferably from 0.3 to 5%, based on the entire amount of the ink.

In the case where a pigment is used as the coloring material of the ink, the concentration of the pure pigment portion in the ink is generally from 0.3 to 10 mass % based on the entire amount of the ink. The coloring power of the pigment depends on the dispersed state of pigment particles, but when the concentration is approximately from 0.3 to 1%, this is in the range of use as a light color ink, whereas the value exceeding the range above gives a concentration employed for normal coloration.

(Preferred Physical Properties of Ink Composition)

Taking into account the ejection property, the ink composition of the present invention preferably has an ink viscosity of 20 mPa·s or less, more preferably 10 mPa·s or less, at the ejection temperature, and an appropriate compositional ratio is preferably determined to give an ink viscosity in this range.

The surface tension in common of the ink composition of the present invention is preferably from 20 to 40 mN/m, more preferably from 25 to 35 mN/m. In the case of recording an image on various recording mediums such as polyolefins, PET, coated paper and non-coated paper, the surface tension is preferably 20 mN/m or more in view of bleeding and penetration and is preferably 40 mN/m or less in view of wettability.

The thus-prepared ink composition of the present invention is suitably used as an ink for inkjet recording. In the case of using the ink composition as an ink for inkjet recording, the ink composition is ejected on a recording medium by an inkjet printer and the ink composition ejected is then cured by irradiating thereon active energy, whereby recording is performed.

The printed matter obtained using this ink has an image area cured by the irradiation of active energy such as ultraviolet ray and is assured of excellent strength of the image area and therefore, the ink composition can be used for various uses such as formation of an ink-receiving layer (image area) of a lithographic printing plate, other than the formation of an image.

The present application claims foreign priority based on Japanese Patent Application (JP2006-190446) filed Jul. 11, 2006, the contents of which is incorporated herein by reference.

What is claimed is:

1. An inkjet recording apparatus comprising:

a full-line inkjet head that includes ejection nozzles arrayed in the width direction of a recording medium, and that ejects a liquid functional material on the recording medium;

a conveying unit that conveys the recording medium at a position facing the full-line inkjet head;

a die-cutting mechanism that die-cuts the recording medium at least partially as a test image formation sheet;

a test image formation sheet-separating unit that separates the test image formation sheet from the recording medium in the downstream of the ejection position on the conveying unit; and an image analyzing unit that scan-reads and analyzes the test image on the test image formation sheet separated by the test image formation sheet-separating unit, and that feeds back the analysis results to an image recording.

2. The inkjet recording apparatus as claimed in claim 1, wherein the conveying unit comprises a recording medium-to-head distance-adjusting mechanism that moves at least one of the recording medium and the inkjet head in the horizontal direction with respect to the ejection direction of the full-line inkjet head so as to set distance between the test image formation sheet and the full-line inkjet head to an optimal value for ejection.

3. The inkjet recording apparatus as claimed in claim 1, wherein the test image formation sheet-separating unit separates the test image formation sheet from the recording medium by electrostatic adsorption or by using a self-adhesive roller.

4. The inkjet recording apparatus as claimed in claim 1, wherein the test image formation sheet-feeding unit feeds the test image formation sheet on the recording medium at predetermined time intervals at least one of in forming the image and in sleeping an image formation.

* * * * *